US006876826B2

(12) United States Patent
Noda et al.

(10) Patent No.: US 6,876,826 B2
(45) Date of Patent: Apr. 5, 2005

(54) ELECTROPHOTOGRAPHIC IMAGE FORMING APPARATUS HAVING DETACHABLE PROCESS CARTRIDGE

(75) Inventors: Shinya Noda, Shizuoka (JP); Kenji Matsusaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/256,147

(22) Filed: Sep. 27, 2002

(65) Prior Publication Data

US 2003/0091361 A1 May 15, 2003

(30) Foreign Application Priority Data

Oct. 1, 2001 (JP) ..... 2001/305128
Sep. 25, 2002 (JP) ..... 2002/279175

(51) Int. Cl.[7] ..... G03G 21/18; G03G 21/16
(52) U.S. Cl. ..... 399/90; 399/111; 399/114
(58) Field of Search ..... 399/12, 90, 107, 399/111, 114, 125, 126

(56) References Cited

U.S. PATENT DOCUMENTS

| | | | | |
|---|---|---|---|---|
| 4,978,817 | A | 12/1990 | Honda | 200/50 |
| 5,331,372 | A | 7/1994 | Tsuda et al. | |
| 5,404,198 | A | 4/1995 | Noda et al. | |
| 5,488,459 | A | 1/1996 | Tsuda et al. | |
| 5,583,613 | A | 12/1996 | Kobayashi et al. | |
| 5,608,509 | A | 3/1997 | Shirai et al. | 399/351 |
| 5,623,328 | A | 4/1997 | Tsuda et al. | 399/111 |
| 5,659,847 | A | 8/1997 | Tsuda et al. | 399/113 |
| 5,669,042 | A | 9/1997 | Kobayashi et al. | 399/111 |
| 5,828,928 | A | 10/1998 | Sasago et al. | 399/111 |
| 5,937,239 | A | 8/1999 | Watanabe et al. | 399/111 |
| 6,185,390 | B1 | 2/2001 | Higeta et al. | 399/90 |
| 6,201,935 | B1 | 3/2001 | Terada et al. | 399/13 |
| 6,229,974 | B1 * | 5/2001 | Noda | 399/111 |
| 6,400,914 | B1 | 6/2002 | Noda et al. | 399/90 |
| 6,661,977 | B1 * | 12/2003 | Kubota | 399/12 |

FOREIGN PATENT DOCUMENTS

| | | |
|---|---|---|
| CN | 1156851 | 8/1997 |
| EP | 0 770 936 | 5/1997 |
| JP | 11-174933 | 7/1999 |
| JP | 2002-072782 | 3/2002 |
| JP | 2002-072783 | 3/2002 |
| JP | 2002-072784 | 3/2002 |
| JP | 2002-072823 | 3/2002 |
| JP | 2002-072824 | 3/2002 |
| JP | 2002-072825 | 3/2002 |

* cited by examiner

*Primary Examiner*—Hoang Ngo
(74) *Attorney, Agent, or Firm*—Fitzpatrick, Cella, Harper & Scinto

(57) ABSTRACT

An electrophotographic image forming apparatus on which a process cartridge having a memory device having a cartridge electrical contact is detachably mountable has an openable and closable cover, a main body positioning portion for positioning a positioning member provided on the process cartridge to thereby position the process cartridge relative to the main body of the electrophotographic image forming apparatus when the process cartridge is to be mounted on the main body of the electrophotographic image forming apparatus, a main body electrical contact portion electrically connected to the cartridge electrical contact portion, and a moving member for making the main body electrical contact portion movable in operative association with the opening and closing operation of the openable and closable cover.

16 Claims, 32 Drawing Sheets

ELECTROPHOTOGRAPHIC IMAGE FORMING APPARATUS HAVING DETACHABLE PROCESS CARTRIDGE

BACKGROUND OF THE INVENTION

1. Field of the Invention

This invention relates to an electrophotographic image forming apparatus on which a process cartridge is detachably mountable.

2. Description of Related Art

Here, an electrophotographic image forming apparatus serves to form an image on a recording medium by the use of the electrophotographic image forming process. Examples of an electrophotographic image forming apparatus include, for example, an electrophotographic copying machine, an electrophotographic printer (such as a laser printer or an LED printer), a facsimile apparatus, a word processor and a machine combining one or more of these (such as a multifunction printer).

The process cartridge sometimes refers to charging means, developing means, cleaning means and an electrophotographic photosensitive body integrally made into a cartridge which is made detachably mountable on an image forming apparatus main body. Alternately, it refers to at least one of charging means, developing means and cleaning means and an electrophotographic photosensitive body integrally made into a cartridge which is made detachably mountable on the image forming apparatus main body. Further, it refers to at least developing means and an electrophotographic photosensitive body integrally made into a cartridge which is made detachably mountable on an image forming apparatus main body.

Heretofore, in an electrophotographic image forming apparatus using the electrophotographic image forming process, there has been adopted a process cartridge system in which an electrophotographic photosensitive body and process means acting on the electrophotographic photosensitive body are integrally made into a cartridge which is made detachably mountable on an image forming apparatus main body. According to this process cartridge system, the maintenance of the apparatus could be done by a user himself without resort to a serviceman and therefore, the operability of the apparatus could be markedly improved. So, this process cartridge system is widely used in image forming apparatuses.

To obtain a good image in an electrophotographic image forming apparatus using such a process cartridge, it is necessary that the process cartridge be properly mounted at a predetermined position in the electrophotographic image forming apparatus main body and interface parts such as various electrical contacts and a drive transmitting part be properly connected together.

So, there has been proposed a mechanism for detachably mounting a process cartridge as shown in Japanese Patent Application Laid-Open No. 11-174933. This is a mechanism which is provided with a main body guide movable in the image forming apparatus and in which an openable and closable cover and the main body guide are connected together by a connecting member, whereby the main body guide is operatively associated with the opening and closing operation of the openable and closable cover. Thereby, the process cartridge placed on the main body guide passes along a predetermined locus in the main body with the closing operation of the openable and closable cover and is properly transported to an operating position and therefore a positioning part and various electrical contacts are properly connected together, and is drawn out to a position easy to take it out by the opening operation of the openable and closable cover.

Also, it is unnecessary to push the process cartridge into the inner part of the image forming apparatus main body when the user mounts the process cartridge on the image forming apparatus main body, and the process cartridge is automatically mounted by the user closing the openable and closable cover and therefore, the operability of the apparatus is good.

The present invention is a further development of the aforedescribed conventional system.

SUMMARY OF THE INVENTION

It is an object of the present invention to provide an electrophotographic image forming apparatus in which a main body electrical contact provided in the electrophotographic image forming apparatus and the cartridge electrical contact part of memory means provided in a process cartridge detachably mountable on the main body of the apparatus can be reliably brought into contact with each other in a stable state.

It is another object of the present invention to provide an electrophotographic image forming apparatus in which when a main body electrical contact provided in the electrophotographic image forming apparatus and the cartridge electrical contact portion of memory means provided in a process cartridge detachably mountable on the main body of the apparatus are to contact with each other, dust and stains adhering to the cartridge electrical contact portion can be removed to thereby reliably bring the two into contact with each other.

It is another object of the present invention to provide an electrophotographic image forming apparatus in which the accuracy of a position at which a main body electrical contact provided in the electrophotographic image forming apparatus the cartridge electrical contact portion of memory means provided in a process cartridge detachably mountable on the main body of the apparatus contact with each other can be improved.

It is another object of the present invention to provide an electrophotographic image forming apparatus in which when an openable and closable cover is moved from the closing position to the opening position, design is made such that a main body electrical contact portion and a cartridge electrical contact portion are electrically spaced apart from each other after a switch member provided in the electrophotographic image forming apparatus has been brought from its ON state to its OFF state, whereby the main body electrical contact portion and the cartridge electrical contact portion can be prevented from being inadvertently spaced apart from each other.

It is another object of the present invention to provide an electrophotographic image forming apparatus on which a process cartridge having an electrophotographic photosensitive body, process means for acting on the electrophotographic photosensitive body, and memory means having a cartridge electrical contact is detachably mount and which is for forming an image on a recording medium, having:

an opening for detachably mounting the process cartridge therethrough;

an openable and closable cover for opening and closing the opening, and capable of assuming an opening position for opening the opening and a closing position for closing the opening;

a main body positioning portion for positioning a positioning member provided on the process cartridge when the process cartridge is to be mounted on the main body of the electrophotographic image forming apparatus, thereby positioning the process cartridge relative to the main body of the electrophotographic image forming apparatus;

a main body electrical contact portion electrically connected to the cartridge electrical contact portion; and a moving member for making the main body electrical contact portion movable in operative association with the opening and closing operation of the openable and closable cover, and abutting against a portion to be biased provided on the positioning member of the process cartridge to thereby move the positioning member toward the main body positioning portion, and biasing the portion to be biased in a direction in which the positioning member and the main body positioning portion after the positioning member has contacted with the main body positioning portion;

wherein when the openable and closable cover is moved from the opening position to the closing position, the main body electrical contact and a cartridge electrical contact are electrically connected together before the moving member abuts against the portion to be biased.

It is another object of the present invention to provide an electrophotographic image forming apparatus on which a process cartridge having an electrophotographic photosensitive body, process means for acting on the electrophotographic photosensitive body, and memory means having a cartridge electrical contact portion is detachably mountable and which is for forming an image on a recording medium, having:

an opening for mounting and dismounting the process cartridge therethrough;

an openable and closable cover for opening and closing the opening, and capable of assuming an opening position for opening the opening and a closing position for closing the opening;

a switch member capable of assuming an ON state for supplying electric power to the main body of the electrophotographic image forming apparatus when the openable and closable cover is in the closing position, and an OFF state for stopping the supply of the electric power to the main body of the image forming apparatus when the openable and closable cover in other position than the closing position;

a main body positioning portion for positioning a positioning member provided on the process cartridge to thereby position the process cartridge relative to the main body of the electrophotographic image forming apparatus when the process cartridge is to be mounted on the main body of the electrophotographic image forming apparatus;

a main body electrical contact portion electrically connected to the cartridge electrical contact portion; and a moving member for making the main body electrical contact portion movable in operative association with the opening and closing operation of the openable and closable cover;

wherein when the openable and closable cover is moved from the closing position to the opening position, the main body electrical contact portion and the cartridge electrical contact portion are electrically spaced apart from each other after the switch member has been brought from the ON state to the OFF state.

DESCRIPTION OF THE PREFERRED EMBODIMENTS

Embodiment 1

A contact abutting mechanism according to the present invention will hereinafter be described in detail with reference to the drawings.

In the following description, the longitudinal direction of a process cartridge is defined as a direction intersecting with (substantially orthogonal to) a direction in which the process cartridge is mounted and dismounted with respect to an apparatus main body, and is a direction parallel to the surface of a recording medium and intersecting with (substantially orthogonal to) the transport direction of the recording medium. Also, right or left is the right or left when the recording medium is seen from above it in accordance with the transport direction of the recording medium. Also, the upper surface of the process cartridge is a surface overlying in a state in which the process cartridge is mounted on the apparatus main body, and the lower surface of the process cartridge is an underlying surface.

Figure 1:
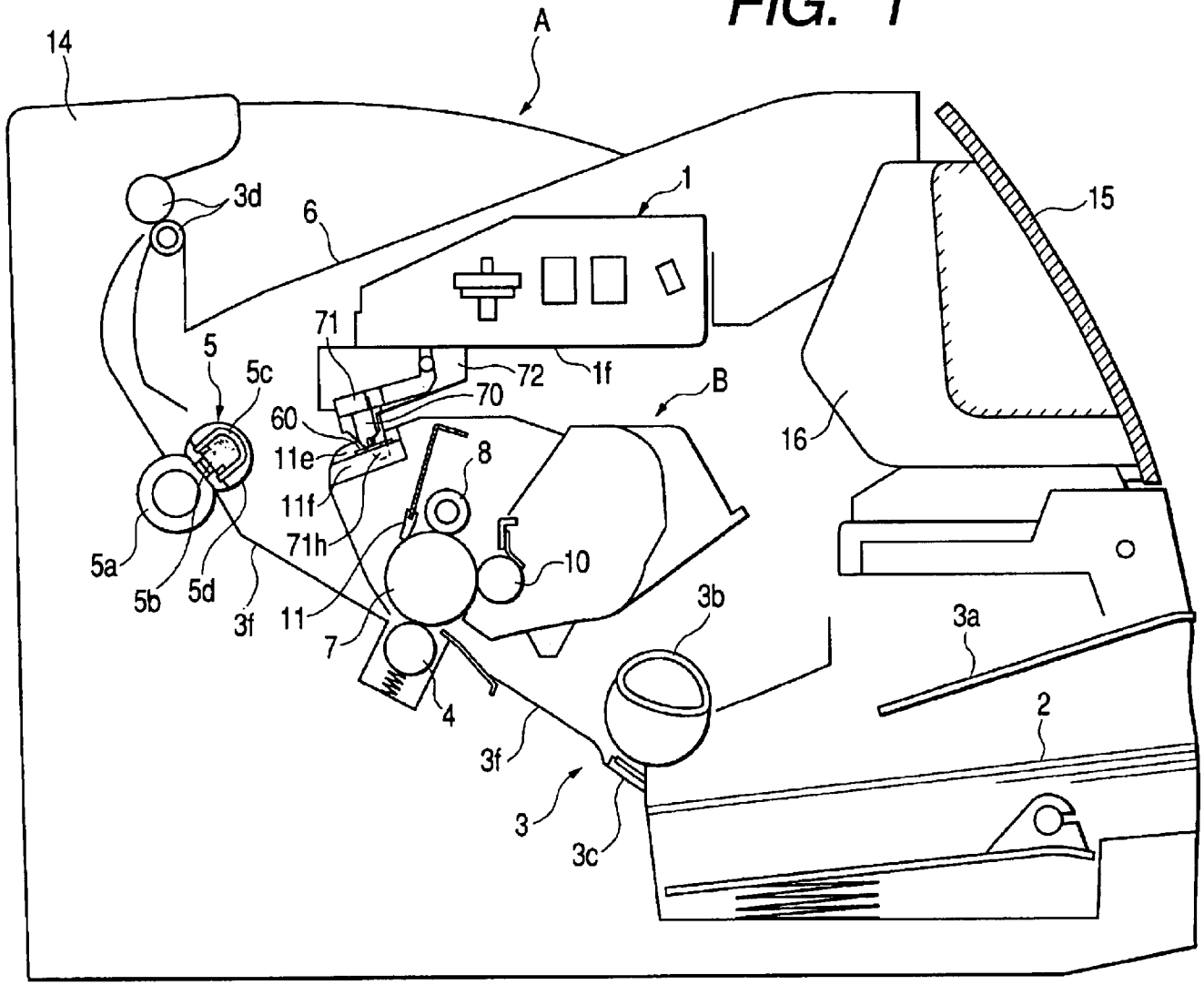
FIG. 1 is a longitudinal cross-sectional view of an electrophotographic image forming apparatus.
Figure 2:
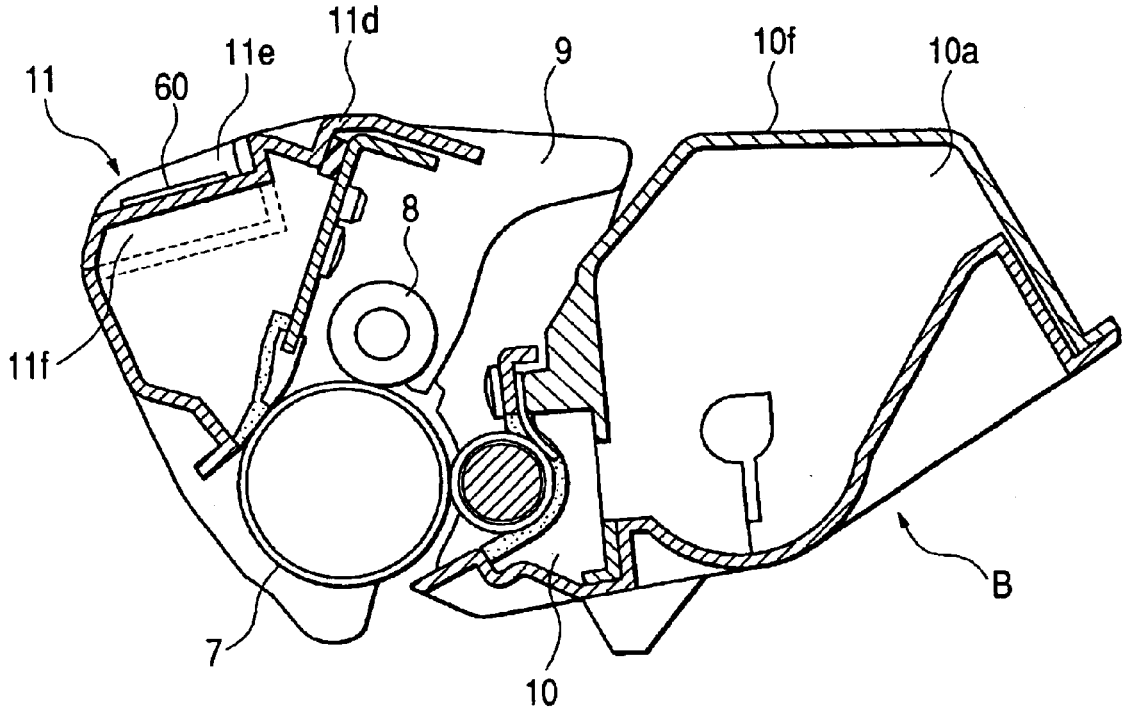
FIG. 2 is a longitudinal cross-sectional view of a process cartridge.

FIG. 1 shows Embodiment 1 of an electrophotographic image forming apparatus embodying the present invention. In the present embodiment, the electrophotographic image forming apparatus enables a process cartridge B shown in FIG. 2 to be detachably mounted thereon. FIG. 1 is an illustration showing a typical construction of an electrophotographic image forming apparatus with the process cartridge B mounted thereon, and FIG. 2 is an illustration showing a typical construction of the process cartridge.

Here, as the order of description, the process cartridge B and the general construction of the electrophotographic image forming apparatus using the same will first be described, and then the construction regarding a mounting and dismounting mechanism and a movable connector mechanism in the present invention will be described.

General Construction

In the present embodiment, the electrophotographic image forming apparatus A (hereinafter referred to as the "image forming apparatus") which is a laser beam printer, as shown in FIG. 1, has a drum-shaped electrophotographic photosensitive body 7 (hereinafter simply referred to as the "photosensitive drum"). The photosensitive drum 7 is uniformly charged by a charging roller 8, serving as charging means. Then, information light based on image information is applied from an optical system 1, serving as optical means to the photosensitive drum 7, whereby an electrostatic latent image is formed on the photosensitive drum 7. This electrostatic latent image is developed with a developer (hereinafter referred to as the "toner") to thereby form a visible image, i.e., a toner image.

In synchronism with the formation of the toner image, recording mediums 2 (such as recording paper, OHP sheets or cloth) are separated and fed one by one from a cassette 3*a* by a pick-up roller 3*b* and a pressure contact member 3*c* which is in pressure contact therewith, and are transported to a transferring position. At the transferring position, the toner image formed on the photosensitive drum 7 is transferred to the recording medium 2 by a voltage being applied to a transferring roller 4 as transferring means. The recording medium 2 to which the toner image has been thus transferred is transported to fixing means 5 along a transport guide 3*f*.

In the present embodiment, the fixing means 5 has a drive roller 5*a* and a fixing rotary member 5*d*. The fixing rotary member 5*d* includes a cylindrical sheet containing a heater 5*b* therein and rotatably supported by a supporting member 5*c*. This fixing means 5 applies heat and pressure to the passing recording medium 2 and fixes the transferred toner image. The recording medium 2 on which the toner image has been thus fixed is transported by discharge rollers 3*d* and is discharged to a discharge area 6 through a reversal transport path.

In the present embodiment, transporting means 3 is constituted by the pick-up roller 3*b*, the pressure contact member 3*c*, the discharge rollers 3*d*, the transport guide 3*f*, etc.

In the image forming apparatus A, there are the transporting means 3, the fixing means 5 and driving means (not shown) for driving the process cartridge B.

Process Cartridge

The process cartridge B is provided with an electrophotographic photosensitive body and at least one process means. The process means includes, for example, charging means for charging the electrophotographic photosensitive body, developing means for developing an electrostatic latent image formed on the electrophotographic photosensitive body, and cleaning means for removing any toner residual on the electrophotographic photosensitive body.

The process cartridge B in the present embodiment, as shown in FIG. 2, is rotatably provided with the photosensitive drum 7 which is an electrophotographic photosensitive body having a photoconductive layer. The surface of the photosensitive drum 7 is uniformly charged by a voltage being applied to a charging roller 8 which may serve as charging means. The thus charged photosensitive drum 7 is exposed to the information light (light image) based on the image information from the optical system 1 through an exposure opening portion 9. As a result, an electrostatic latent image is formed on the surface of the photosensitive drum 7, and this electrostatic latent image is developed by developing means 10.

The process cartridge B shown in the present embodiment has a cleaning frame body 11*d* rotatably supporting the photosensitive drum 7 and having cleaning means 11 and the charging roller 8 incorporated therein, and a toner developing frame body 10*f* incorporating the developing means 10 and a toner containing portion 10*a* therein.

Figure 13:
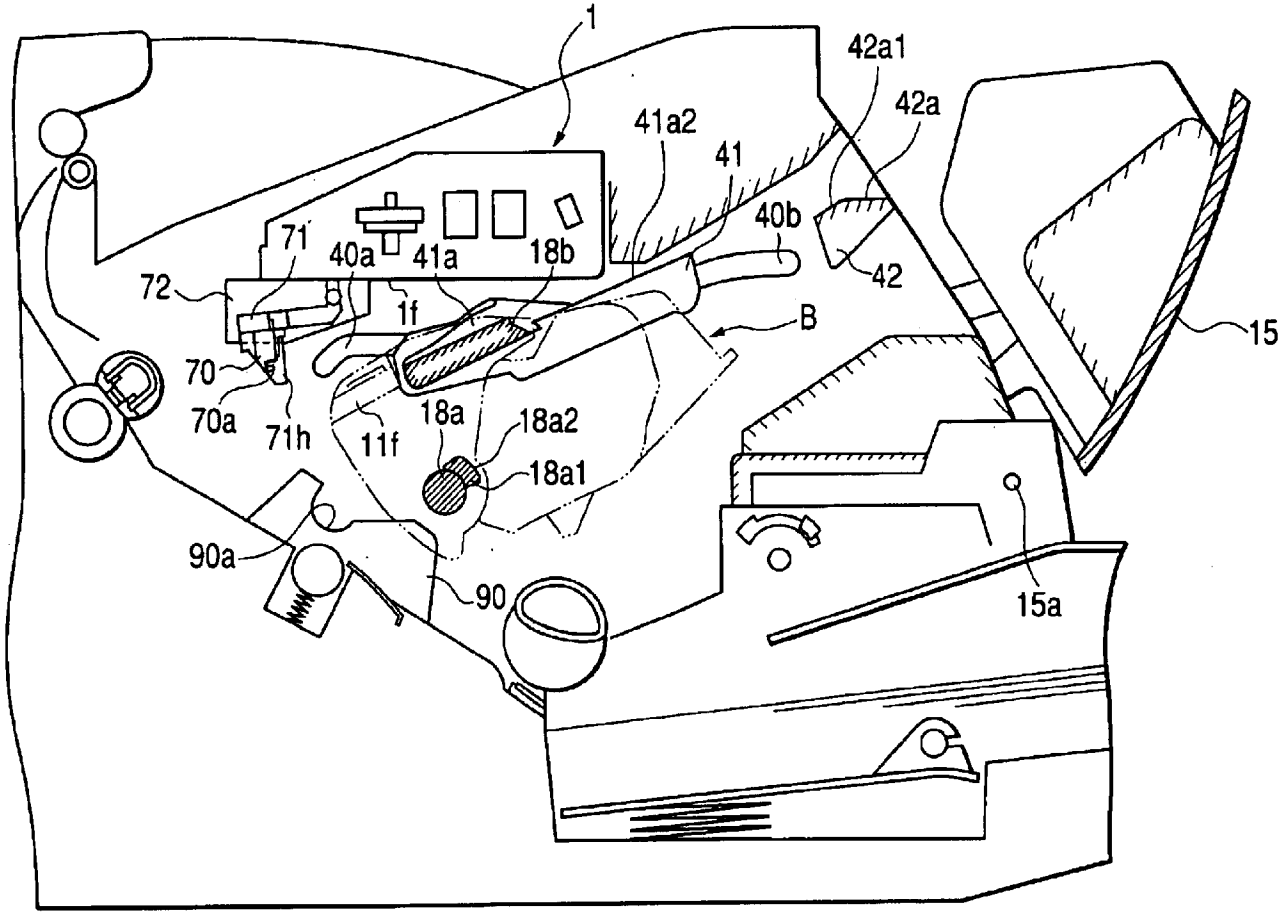
FIG. 13 is a longitudinal cross-sectional view of the apparatus main body showing a state in which the process cartridge has been positioned on the moving guide by the movement of the openable and closable cover.

On the opposite in the longitudinal direction sides of this cleaning frame 11*d*, as shown in FIG. 13, there are provided mounting guides 18*b* for detachably mounting the process cartridge B with respect to an electrophotographic image forming apparatus main body 14 (hereinafter referred to as the "image forming apparatus main body", and further "the apparatus main body") in the downstream direction shown by arrow X, and positioning members 18*a* provided coaxially with the rotary shaft of the photosensitive drum 7 and supported by positioning means in the image forming apparatus. The upstream side or the upstream direction of the process cartridge is defined as the opposite of the direction in which, when the process cartridge is mounted onto the image forming apparatus, the process cartridge proceeds (mounting direction).

Figure 3:
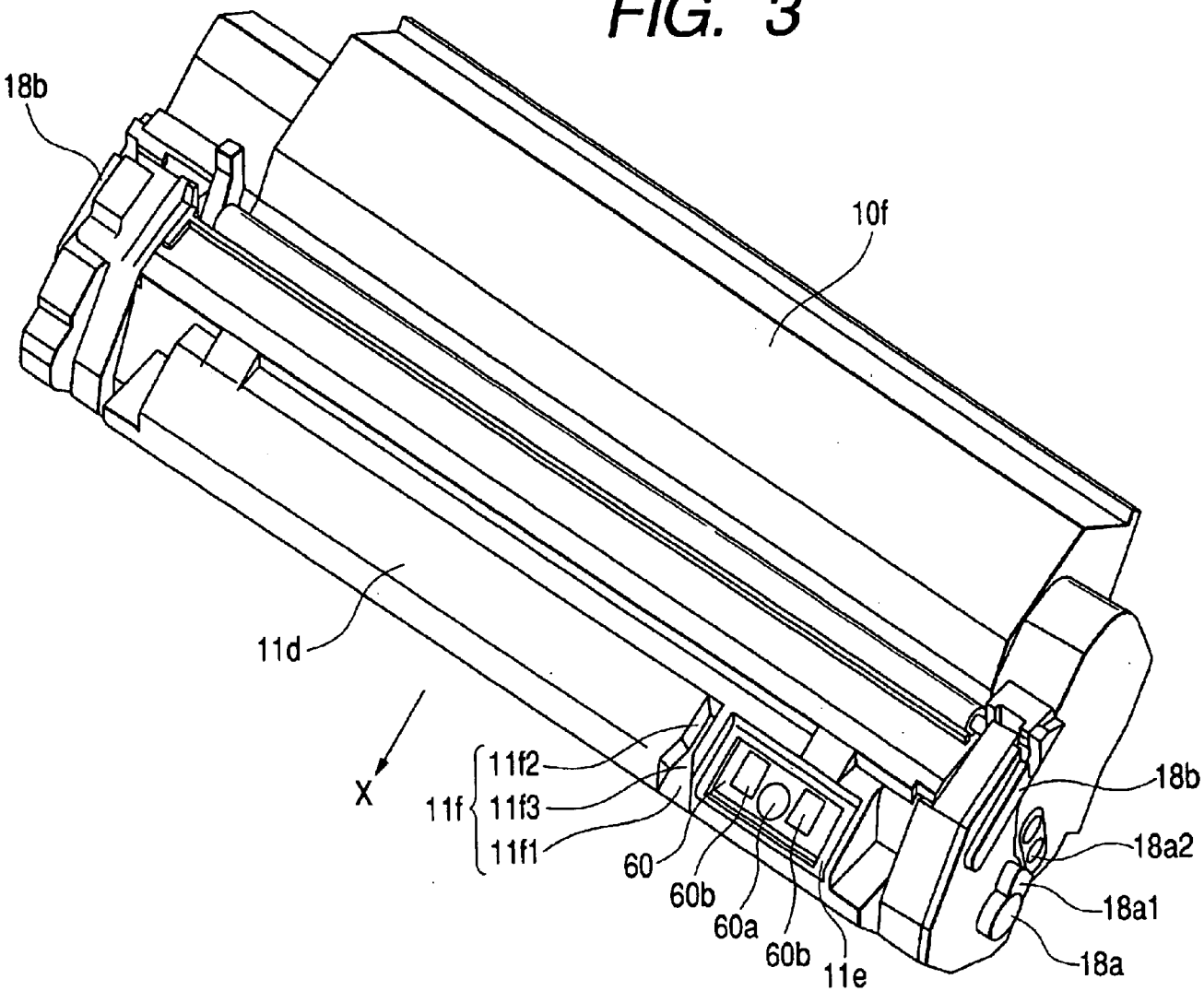
FIG. 3 is a perspective view of the process cartridge.
Figure 20:
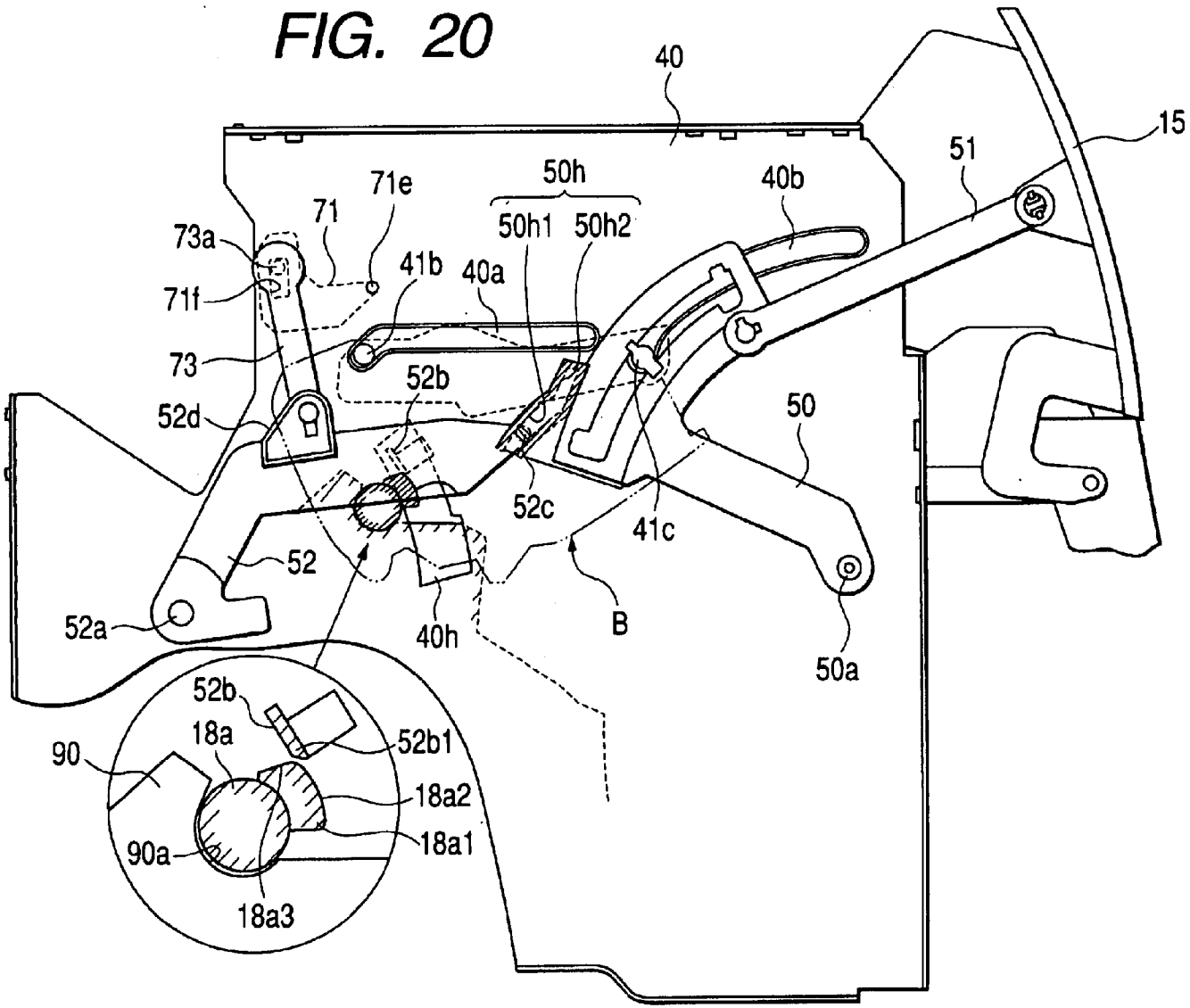
FIG. 20 is a longitudinal cross-sectional view of the apparatus main body showing a link position in which a second cam and a moving member are fitted together by the further movement of the movable and closable cover from the state of FIG. 19.

The positioning members 18*a* are cylindrical bosses having the driving side thereof made large in diameter. The positioning member 18*a* on the counter-driving side shown in FIG. 3 is formed with a portion 18*a*1 to be biased (urged) extending rearwardly in the mounting direction of the process cartridge B (the upstream side with respect to the mounting direction). Also, the portion 18*a*1 to be biased is provided integrally with the positioning member 18*a*. The rear end of this portion 18*a*1 to be biased is an outer peripheral surface 18*a*2 to be biased which is an arc concentric with the positioning member 18*a*. The upper corner of the outer peripheral surface 18*a*2 to be biased which is a side into which the biasing portion 52*b* of a moving member 52 which will be described later comes is chambered at 18*a*3 (FIG. 20).

Also, a concave surface 11*e* is provided on the upper surface portion of the cleaning frame 11*d*, and there is mounted there tag chip 60, serving as memory means having a memory 60*a* and a contact portion 60*b* electrically connected to the memory 60*a*. Also, a slit 11*f* is provided by the side of the concave surface 11*e*. This slit 11*f* differs in width in the insertion direction of the process cartridge B. That is, the slit 11*f* comprises an introduction portion 11*f*1 widened on the downstream side as viewed in the insertion direction, a thrust guide portion 11*f*2 made narrower on the upstream side of the introduction portion 11*f*1 as viewed in the insertion direction than the introduction portion, and an inclined portion 11*f*3 connecting the introduction portion 11*f*1 and the thrust guide portion 11*f*2 together. The width of the thrust guide portion 11*f*2 is somewhat greater than the width of a positioning rib 71*h* extending from the connector holder 71 of a connector mechanism which will be described later (FIG. 1).

Connector Mechanism and Process Cartridge Mounting and Dismounting Mechanism

Figure 14:
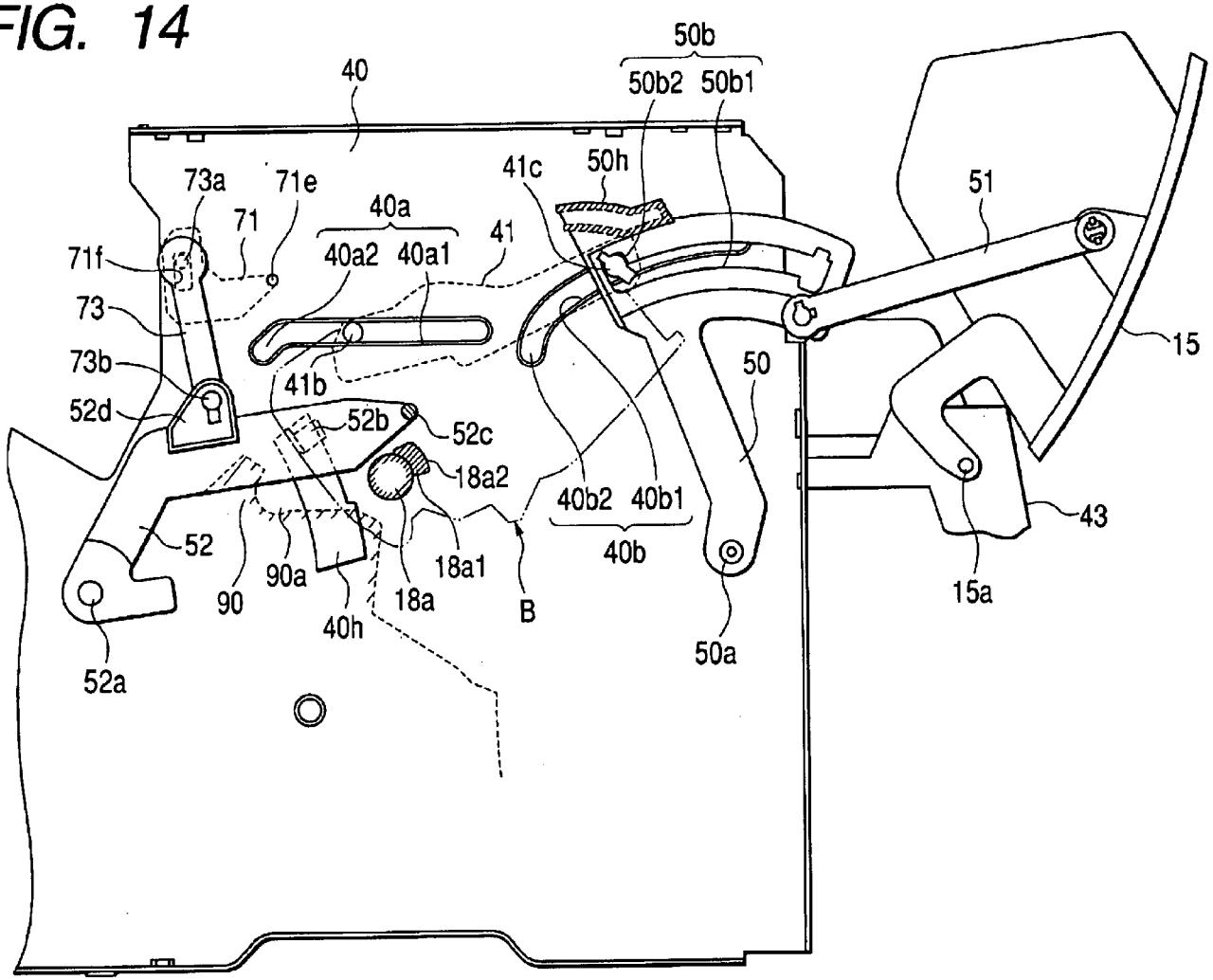
FIG. 14 is a longitudinal cross-sectional view of the apparatus main body showing the position of each link of a link mechanism in the state of FIG. 13.

A process cartridge mounting and dismounting mechanism in the present embodiment, as shown in FIG. 14, comprises a moving guide 41 holding the process cartridge B and moved between the optical system 1 and the transporting means 3, a cam plate 50 for moving the moving guide 41 in the first half of the closing operation of an openable and closable cover 15 and the second half of the opening operation of the openable and closable cover 15, two guide rails 40*a* and 40*b* provided on an inner side plate 40 in the apparatus main body 14, a connecting plate 51 for transmitting the rotating operation of the openable and closable cover 15 to the cam plate 50, and a moving member 52 for holding the process cartridge B in a position in which it can perform the image forming operation after the movement of the process cartridge B.

Figure 9:
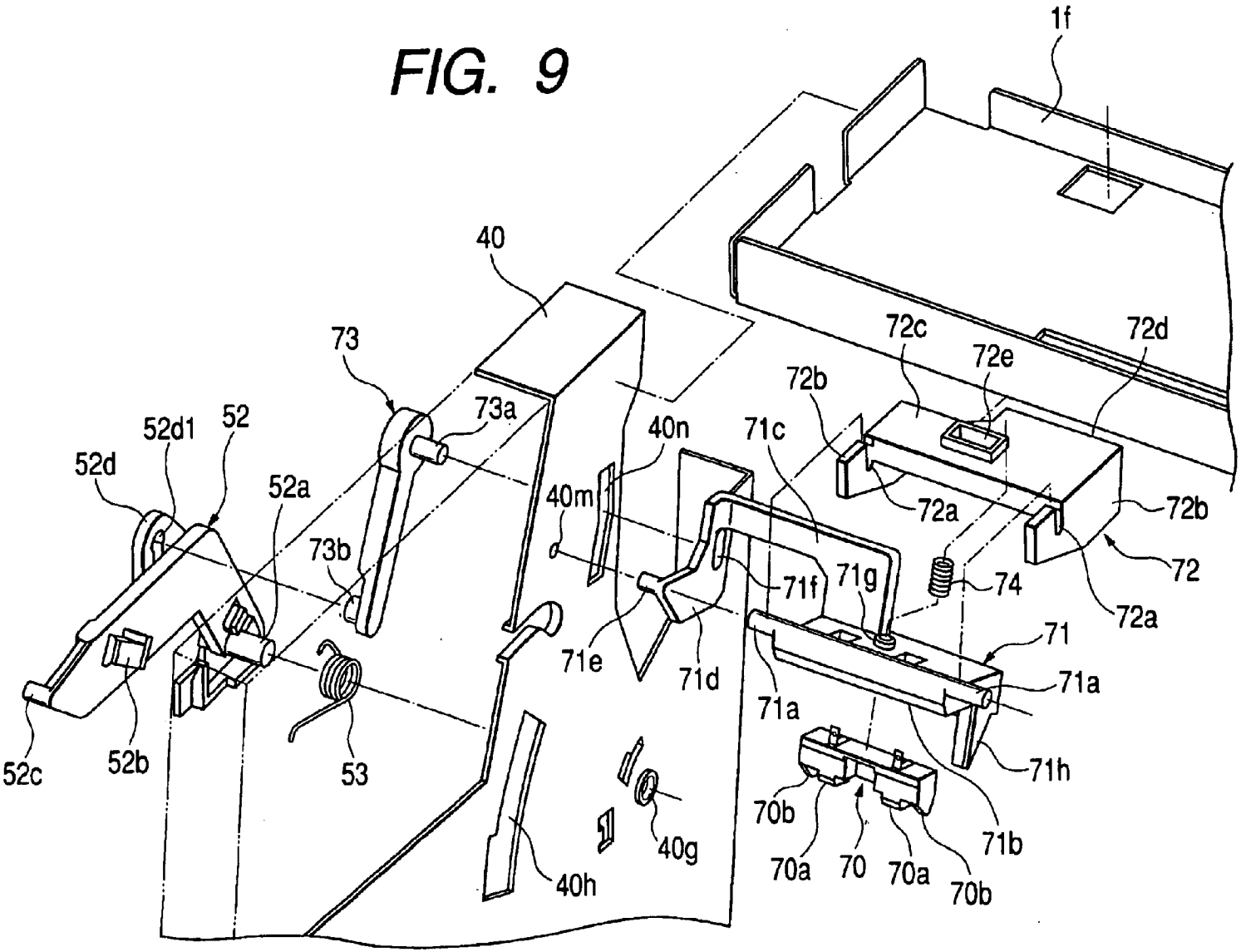
FIG. 9 is a perspective view of the constituent member when the inner side plate on the counter-driving side in the apparatus main body is seen from the inside.
Figure 15:
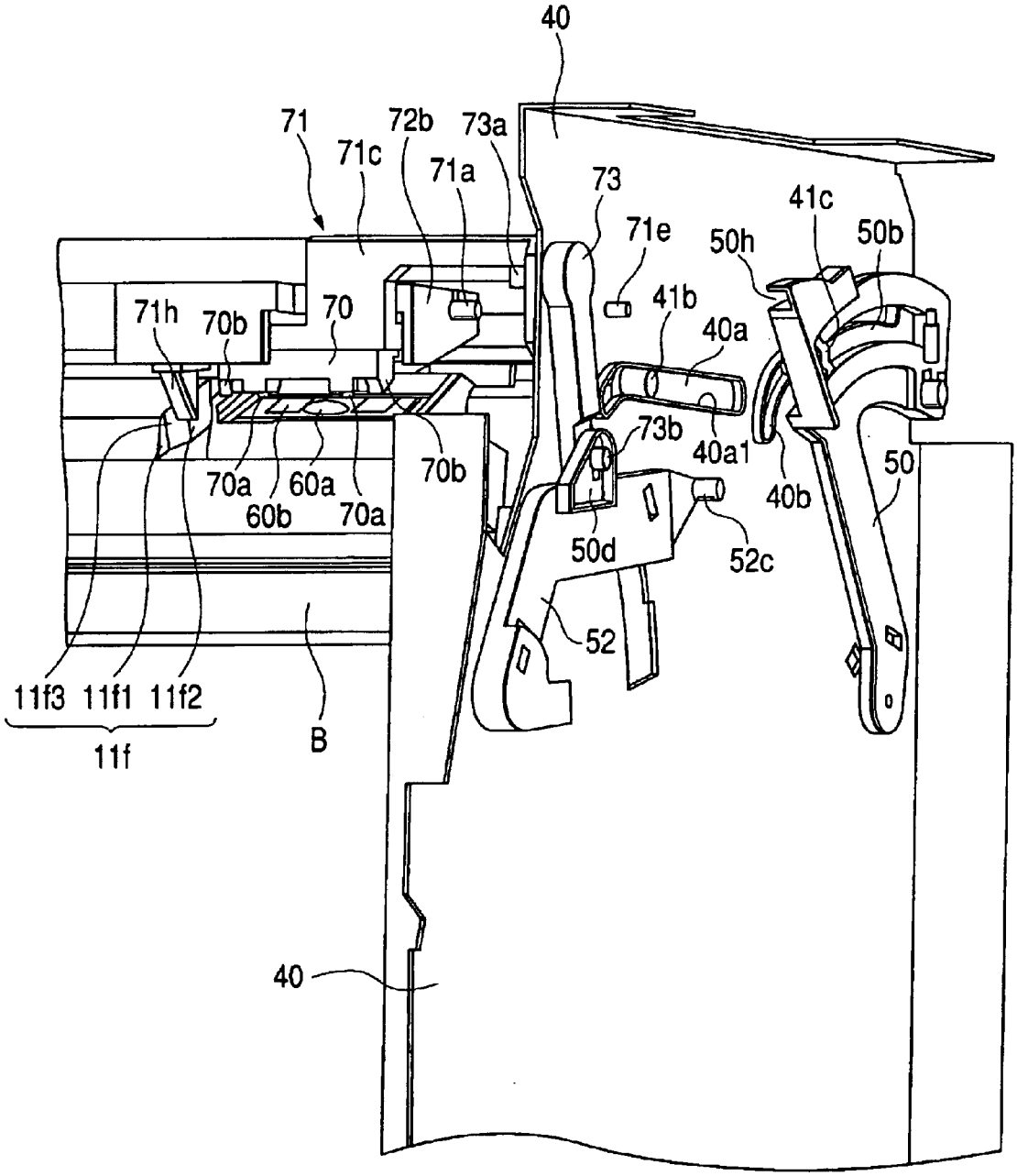
FIG. 15 is a perspective view of the process cartridge and the constituent member when in the state of FIG. 13, the inner side plate on the counter-driving side is seen from a direction opposite to the openable and closable cover.

Also, a movable connector mechanism comprises a connector member 70 provided with an electrical contact, a connector holder 71 for fixing the connector member 70, a housing 72 for supporting the connector holder 71, and a link 73 for connecting the aforedescribed moving member 52 and the connector holder 71 together (FIGS. 9 and 15).

Each constituent part will now be described and the description of the operations of the two mechanisms will be made in accordance with the rotating operation of the openable and closable cover 15.

Description of the Constituent Parts

Moving Guide

Figure 4:
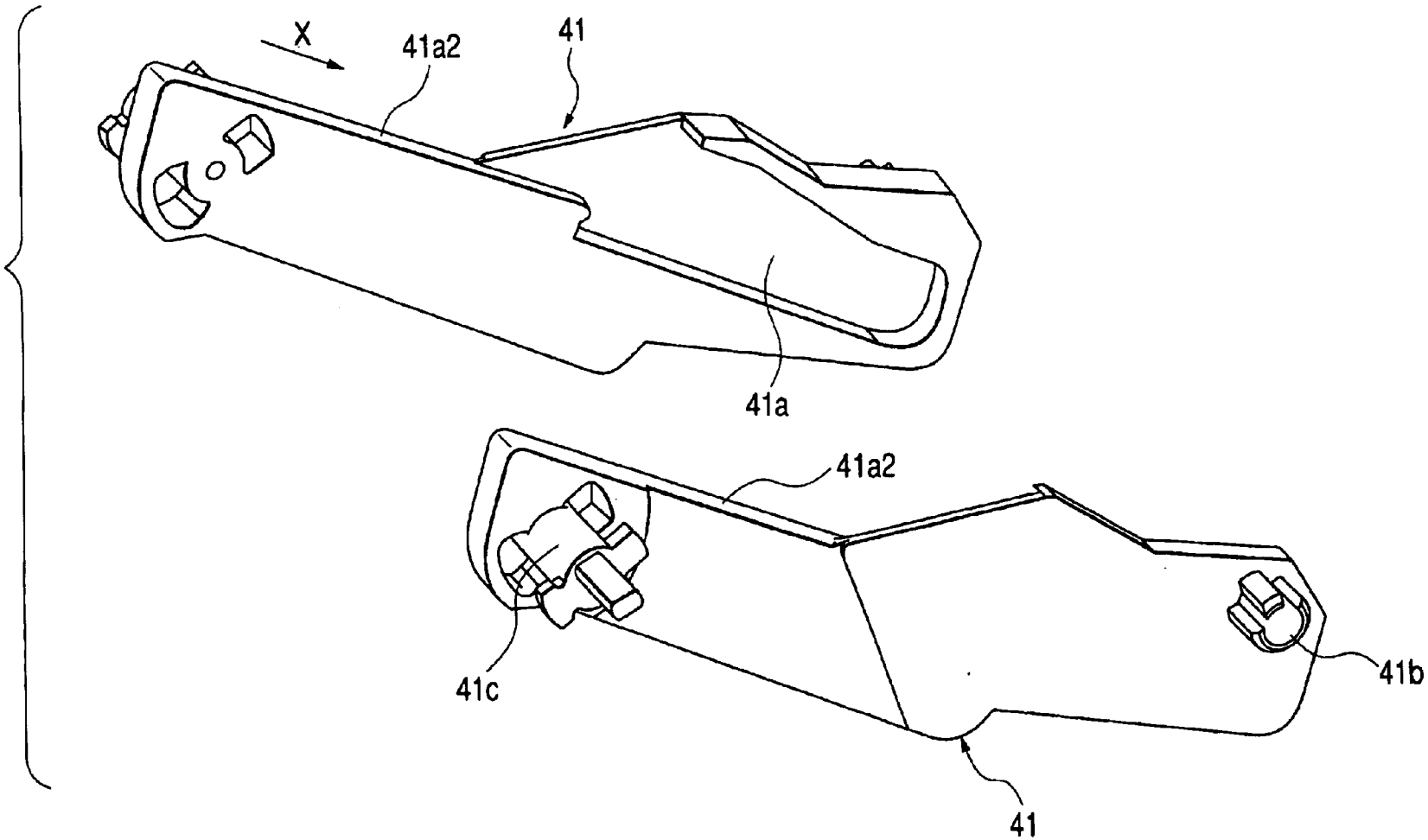
FIG. 4 is a perspective view of a set of moving guides which are a constituent member for mounting the process cartridge on an apparatus main body.

The moving guide 41 is disposed in a substantially symmetrical shape on the right and left inner side plates 40. The moving guide 41, as shown in FIG. 4, has a guide groove 41*a* as a guide portion to which the mounting guide 18*b* of the process cartridge B is fitted in a surface thereof opposed to the process cartridge B, and has a first boss 41*b* and a second boss 41*c* for keeping the posture in the apparatus main body on the opposite surface. The first boss 41*b* is disposed downstream of the guide groove 41*a* with respect to the mounting direction (arrow X) of the process cartridge B, and the second boss 41*c* is disposed upstream of the guide groove 41*a* with respect to the mounting direction (arrow X) of the process cartridge B.

Guide Rails on the Inner Side Plate

Figure 5:
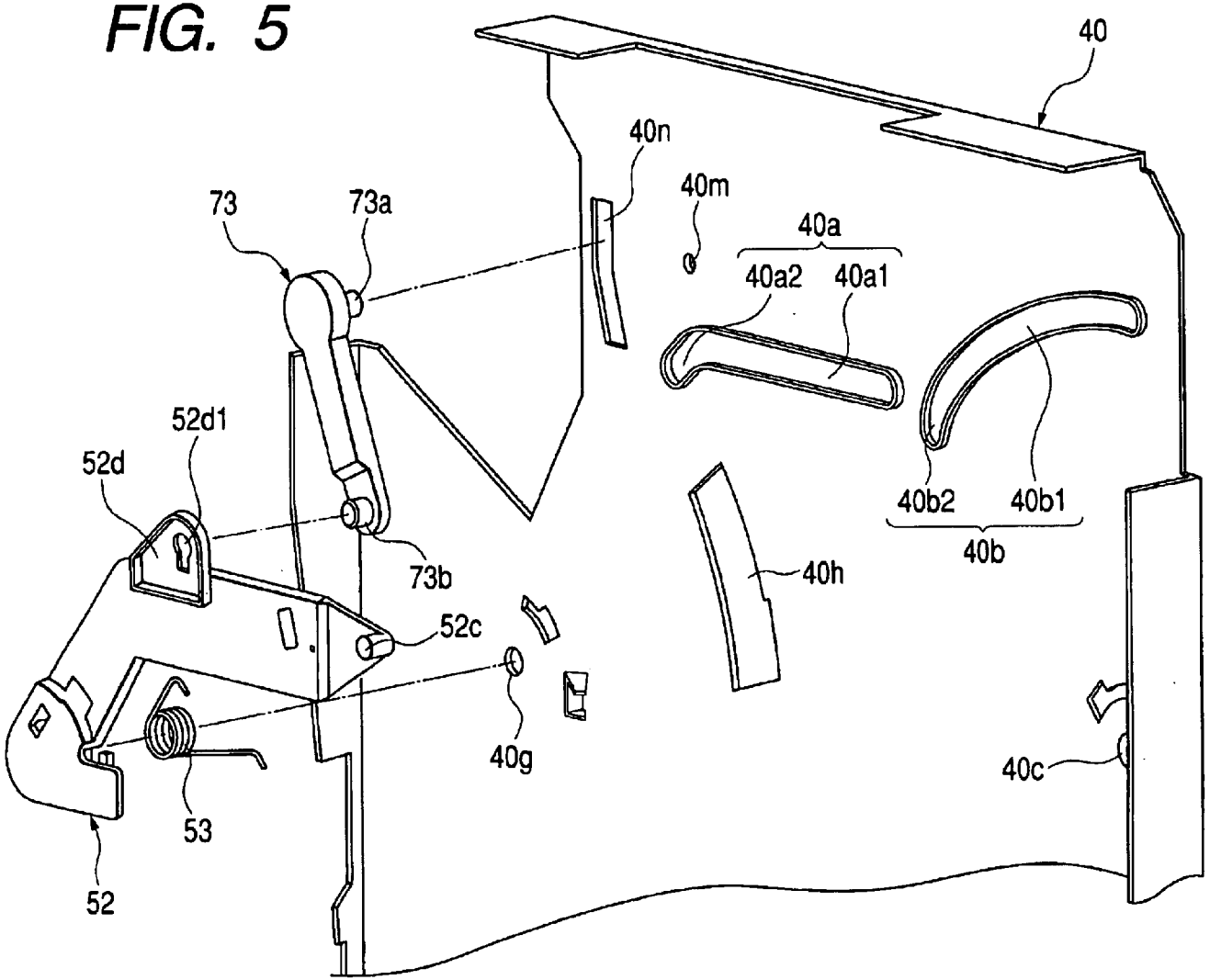
FIG. 5 is a perspective view of the constituent member when the counter-driving side inner side plate in the apparatus main body is seen from the outside.

FIG. 5 shows the left inner side plate 40 of the image forming apparatus main body 14, and on the inner side plate 40, there are provided two guide rails 40*a* and 40*b* to which the bosses 41*b* and 41*c* of the moving guide 41 are discretely slidably fitted.

By these two guide rails 40*a*, 40*b* and the two bosses 41*b*, 41*c* of the moving guide 41, the moving guide 41 is moved in the space between the optical system 1 and the transport path of the recording medium 2.

The first guide rail 40*a* to which the first boss 41*b* is fitted has a shape in which the substantially horizontal portion 40*a*1 thereof which is adjacent to the openable and closable cover 15 and the inclined portion 40*a*2 thereof downwardly inclined toward a transporting surface near the end portion of the interior side of the image forming apparatus main body are smoothly connected together. The second guide rail 40*b* to which the second boss 40*c* is fitted has a shape in which the arcuate portion 40*b*1 thereof which is an upwardly protruded arc and the straight portion 40*b*2 thereof vertically formed on the first guide rail 40*a* side are smoothly connected together by an arc. A rotary hole 40*c* for rotatably receiving therein the rotary shaft 50*a* of a cam plate 50, which will be described later, is formed at the center of the arcuate portion 40*b*1.

Cam Plate

A cam plate 50 having a rotary shaft 50*a* at the center of the arcuate portion 40*b*1 of the second guide rail 40*b* is provided on the outer side of the inner side plate 40, i.e., the surface opposite to the surface on which the moving guide 41 is mounted.

Figure 6:
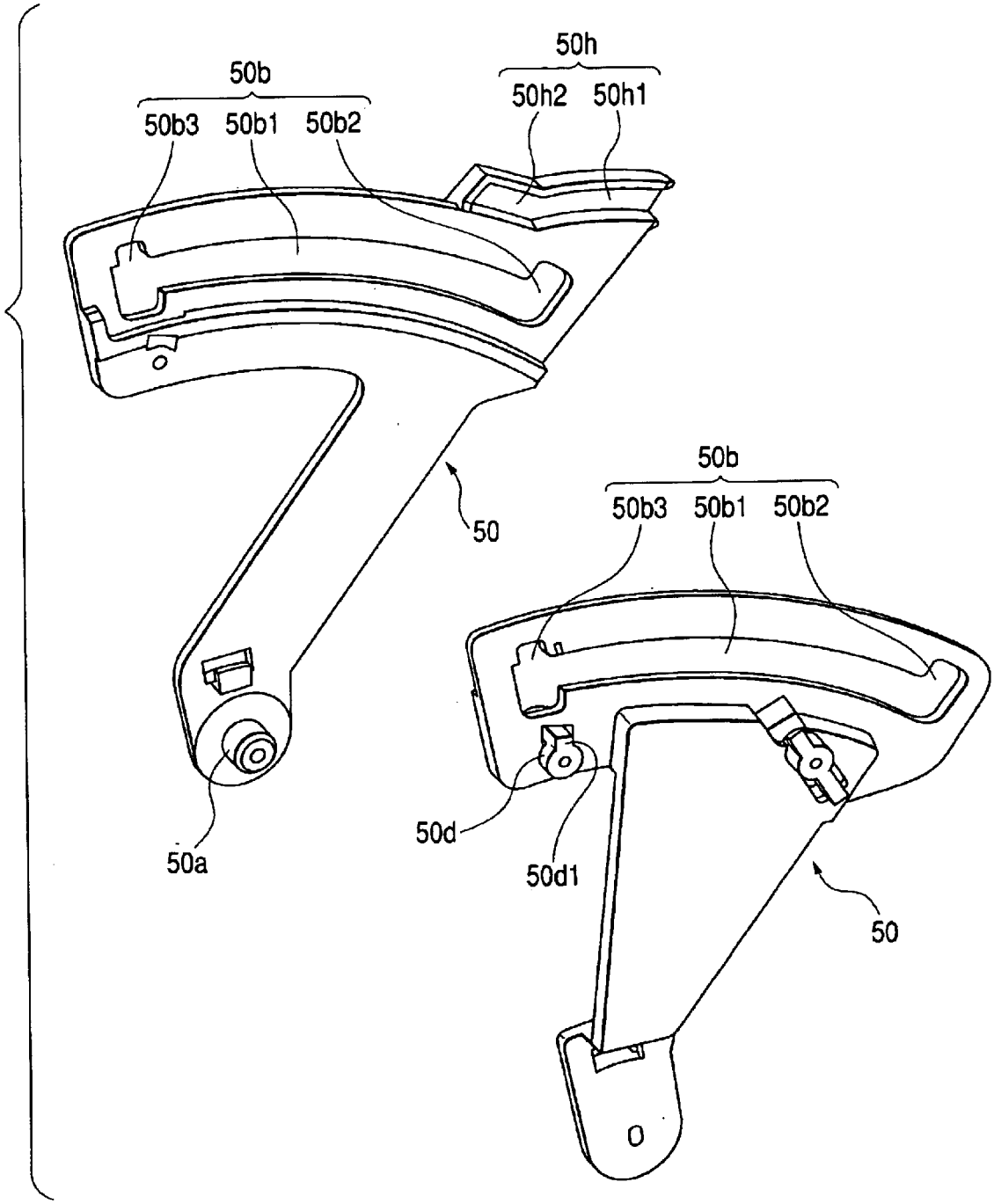
FIG. 6 is a perspective view of a set of cam plates which are a constituent member for mounting the process cartridge on the apparatus main body.

As shown in FIG. 6, this cam plate 50 is formed with a cam groove 50*b* which is a first cam portion. The cam groove 50*b* extends through the cam plate 50. The cam groove 50*b* has an arcuate groove hole (hereinafter referred to as the "arc groove hole") 50*b*1 centering around the rotary shaft 50*a*, and a straight line-shaped groove hole (hereinafter referred to as the straight groove hole) 50*b*2 formed continuously from the end portion of the arc groove hole 50*b*1 which is adjacent to the closing direction side of the openable and closable cover 15, and extending to the radially outer side thereof.

The second boss 41*c* of the moving guide 41 which has passed the second guide rail 40*b* of the inner side plate 40 is fitted into this cam groove 50*b*. The radius of the arc groove hole 50*b*1 is smaller than the radius of the arcuate portion 40*b*1 of the second guide rail 40*b* and is substantially equal to the distance between the lower end of the straight portion 40*b*2 of the second guide rail 40*b* and the rotary hole 40*c*. Also, the distance between the distal end of the straight groove hole 50*b*2 and the rotary shaft 50*a* is substantially equal to the radius of the arcuate portion 40*b*1 of the second guide rail 40*b*. The widths of the arc groove hole 50*b*1 and the straight groove hole 50*b*2 are slightly greater than the diameter of the second boss 41*c* of the moving guide 41.

Near an assembly hole 50*b*3 at the rear end of the cam groove 50*b*, a connecting boss 50*d* having a pawl 50*d*1 at the tip end thereof is provided on the opposite surface of the rotary shaft 50*a*. The substance hitherto described has a shape common to the right and left cam plates 50.

A second cam 50*h* is provided on the cam plate 50 of the counter-driving means side (hereinafter referred to as the left side) on the radially outer side of the vicinity of the straight groove hole 50*b*2. The second cam 50*h* is a portion for driving a moving member 52 which is the left positioning means of the process cartridge B which will be described later, and is formed with an arm driving portion 50*h*1 having the radially outer side thereof with respect to the closing direction of the openable and closable cover 15 and the radially inner side thereof with respect to the opening direction of the openable and closable cover 15 connected together by a gentle arc and an arm holding portion 50*h*2 which is an arc concentric with the rotary shaft of the cam plate 50 formed as grooves opened to the inner side plate 40 side.

Connecting Plate

Figure 7:
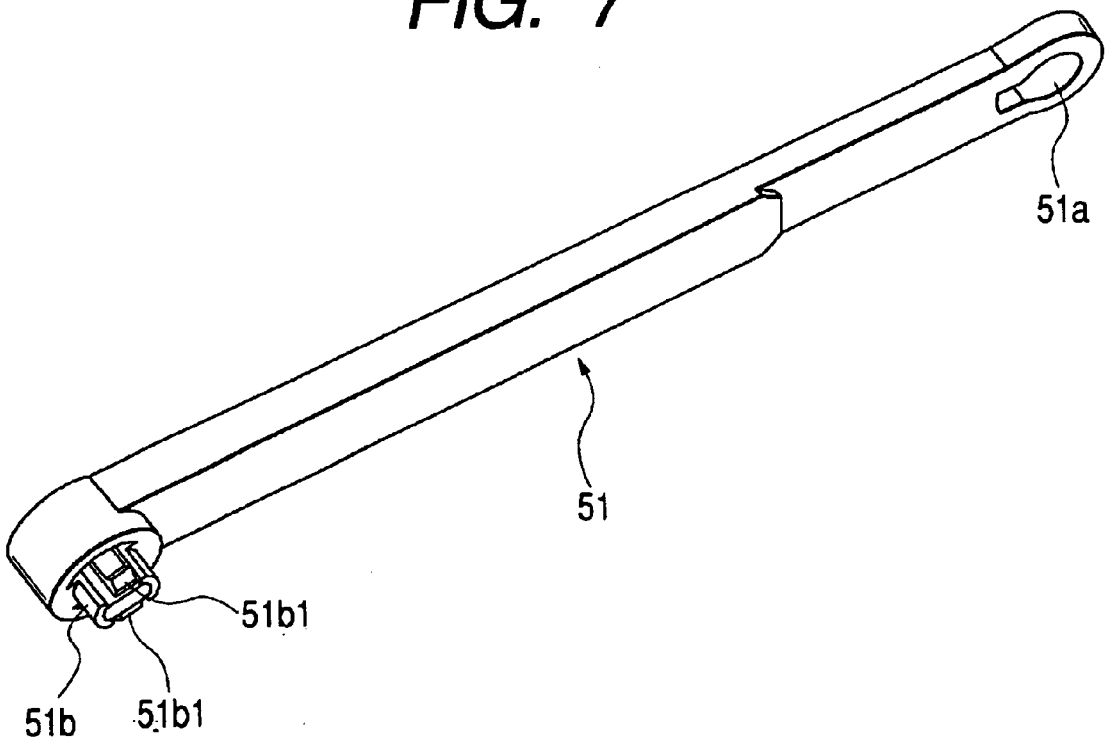
FIG. 7 is a perspective view of a connecting plate on one side for operatively associating the mounting of the process cartridge and an openable and closable cover with each other.

The cam plate 50 and the openable and closable cover 15 are connected together by a connecting plate 51 and constitute a four-node link mechanism. The connecting plate 51, as shown in FIG. 7, has at one end thereof a hole 51*a* rotatably fitted to the connecting boss 50*d* of the cam plate 50 and has at the other end thereof a shaft 51*b* formed with a snap fit pawl 51*b*1.

Openable and Closable Cover and Back Lid

Figure 8:
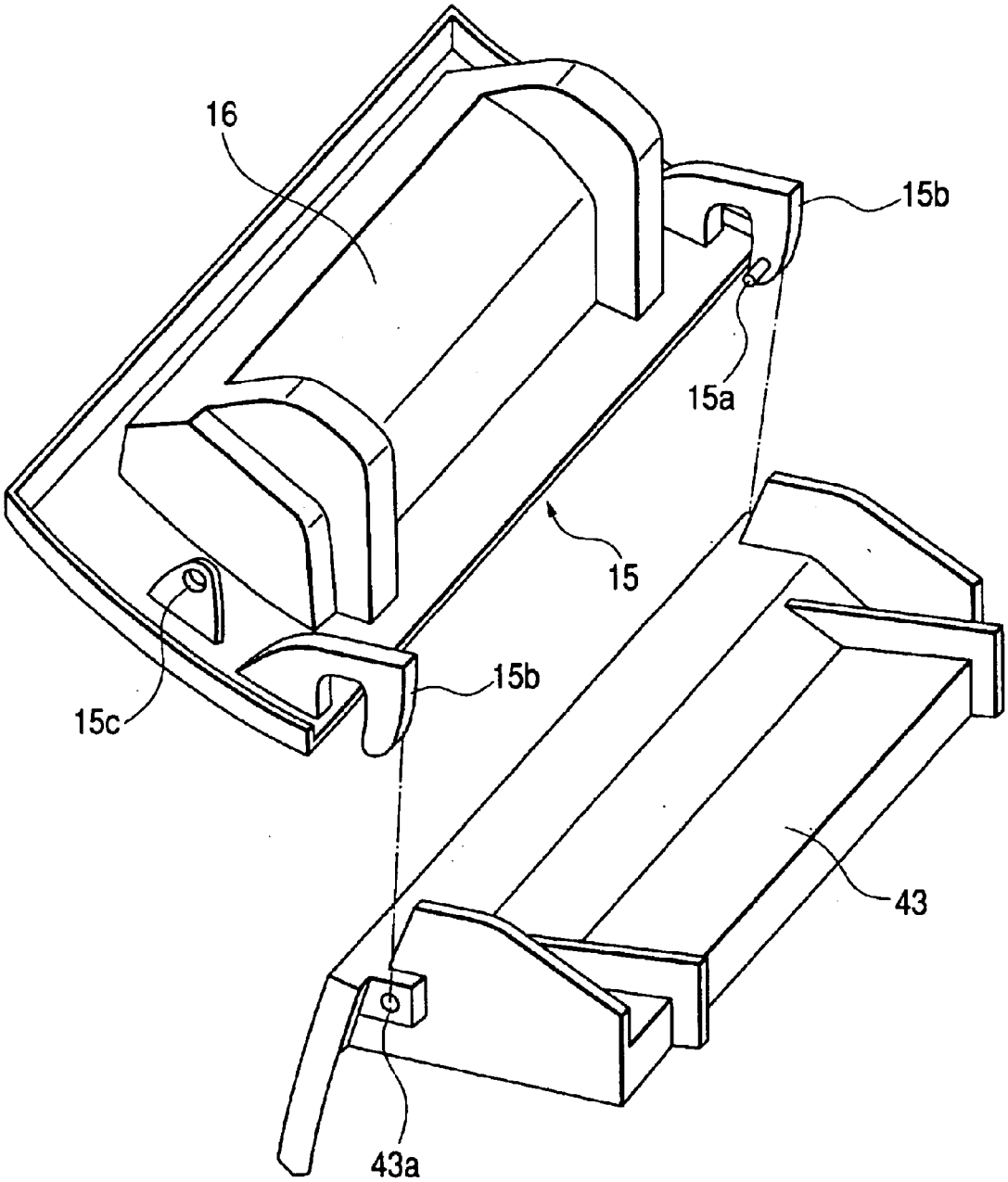
FIG. 8 is a perspective view showing a method of joining the front guide of the apparatus main body and the openable and closable cover to each other.

As shown in FIG. 8, hinges 15*b* having at the tip ends thereof central bosses 15*a* forming a rotation center axis, and connecting holes 15*c* in which the shaft 51*b* of the connecting plate 51 is fitted on the back lid of the openable and closable cover 15 are provided near the opposite end portions, respectively, of the openable and closable cover 15. A back lid 16 for improving the rigidity of the openable and closable cover 15 is fixed to the back of the openable and closable cover 15.

Front Guide

As shown in FIG. 8, a front guide 43 is fixed to and between the right and left inner side plates 40. The front guide 43 is formed with supporting holes 43*a* for rotatably supporting the central bosses 15*a* of the openable and closable cover 15.

Transport Frame

Figure 11:
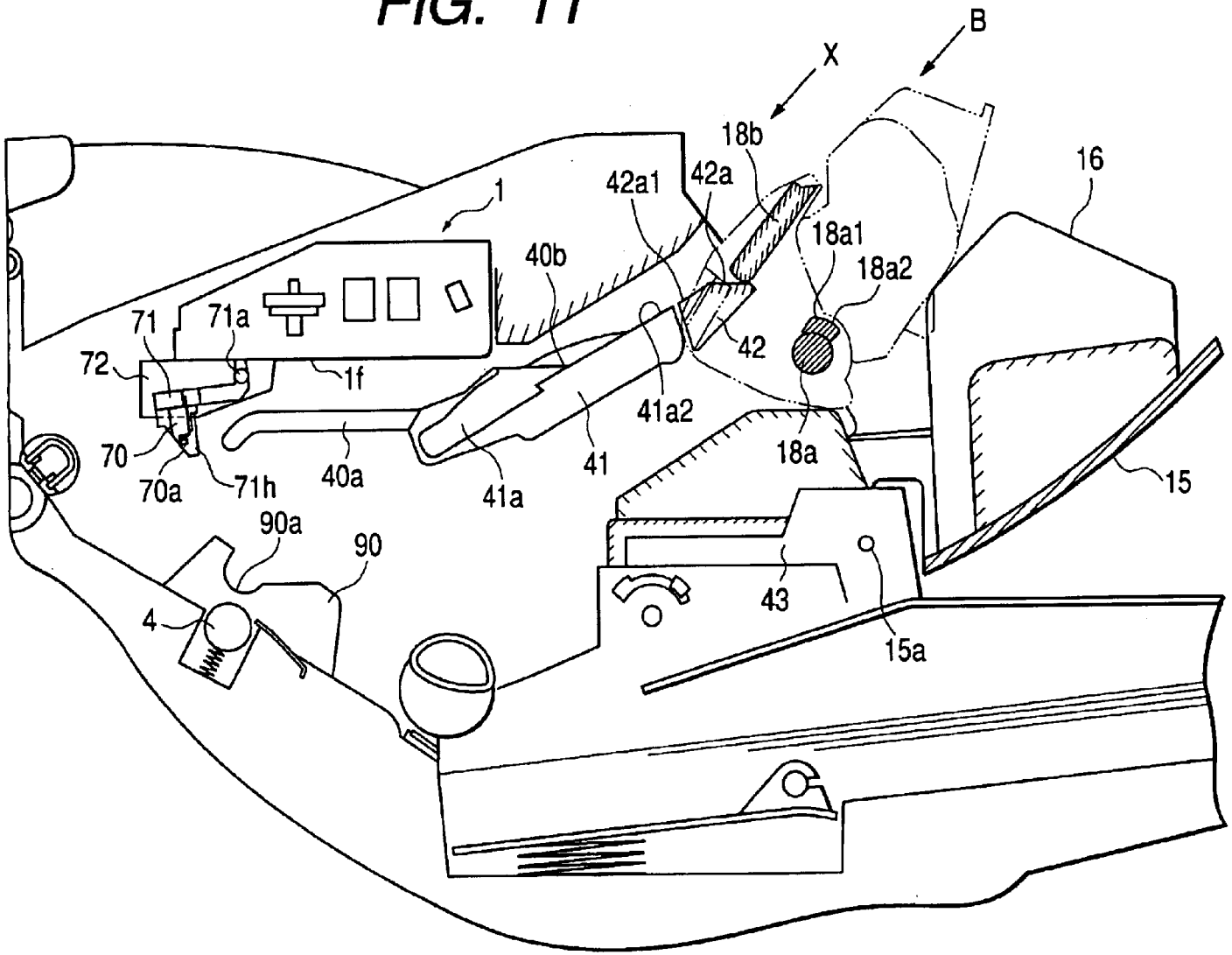
FIG. 11 is a longitudinal cross-sectional view of the apparatus main body showing the states of the insertion initial stage and the taking-out end stage of the process cartridge with the openable and closable cover fully opened.

A bearing (not shown) for rotatably supporting the transferring roller 4 is slidably mounted, and as shown in FIG. 11, a transport frame (conveying frame) 90 constituting a transporting surface for the recording medium is provided with a positioning portion 90*a* which is a main body positioning portion for receiving the positioning member 18*a* of the process cartridge B in a position capable of performing the image forming operation. The positioning portion 90*a* and a moving member 52 which will be described later together constitute left positioning means for the process cartridge B.

As shown in FIGS. 5 and 9, a moving member 52 is provided on the left inner side plate 40. The moving member 52 functions to hold onto positioning portion 90*a* the positioning member 18*a* of the process cartridge B moved in operative association of the closing operation of the openable and closable cover 15 by the operation of the mounting and dismounting mechanism for the process cartridge B.

The moving member 52 has a pivot shaft 52*a* which is pivotally supported in the rotary hole 40*g* of the left inner side plate 40. Also, the moving member 52 is provided with a biasing portion 52*b* passing through the sector hole 40*h* of the left inner side plate 40. The biasing portion 52*b* has a chamber 52*b*1 at a corner of a portion moved back and forth toward the portion 18*a*1 to be biased provided continuously from the positioning member 18*a* of the process cartridge B.

A torsion coil spring 53 is incorporated in the root of the pivot shaft 52*a* of the moving member 52, and upwardly biases the moving member 52 so that the biasing portion 52*b* may not come into the movement locus of the positioning member 18*a* of the process cartridge B.

A boss 52*c* fitted to the second cam 50*h* of the cam plate 50 for pivotally moving the moving member 52 is provided on the moving member 52 on the tip end side of an arm as viewed from the biasing portion (urging portion) 52*b*.

The moving member 52 is further provided with a connecting potion 52*d* surrounding a fitting hole 52*d*1 in which the link member of a movable connector mechanism which will be described later.

Movable Connector Mechanism

The connector mechanism, as shown in FIGS. 3 and 9, include of a connector member 70 having an electrical contact 70*a* which is a main body electrical contact portion electrically contacting with a contact portion 60*b* which is the cartridge electrical contact portion of the aforedescribed tag chip 60 attached to the process cartridge B, a connector holder 71 fixed to the connector member 70 and having a rotary shaft 71*a* and pivotally movable in the image forming apparatus, a housing 72 pivotally supporting the connector holder 71, a link 73 connecting the connector holder 71 and the moving member 52 together, and a compression coil spring 74 for pressing the connector holder 71 against the tag chip 60. The axial direction of the rotary shaft 71*a* of the connector holder 71 is a direction orthogonal to the direction in which the process cartridge B is mounted and dismounted.

On the connector member 70, one or two metallic electrical contacts 70*a* resiliently deformed to thereby produce contact pressure are disposed for one contact portion 60*b* of the tag chip 60. Also, by the side of the electrical contact or contacts 70*a*, dashing portions 70*b* contacting with the tag chip 60 are provided near the lengthwisely opposite ends thereof. A lead wire (not shown) is connected to the side opposite to the portion of contact of the electrical contact or contacts 70*a* with the tag chip 60 and is connected to the control portion (not shown) of the image forming apparatus main body 14. As regards the electrical contact or contacts 70*a* and the dashing portion 70*b*, when the electrical contact or contacts 70*a* contact with the contact portion 60*b* of the tag chip 60, the dashing portion 70*b* is opposed to other surface than the contact portion 60*b* of the tag chip 60 and forms a gap with respect to this surface. When the dashing portion 70*b* is dashed against the tag chip 60, the electrical contact or contacts 70*a* of the connector member 70 are in pressure contact with the contact portion 60*b* and are elastically deformed.

The connector holder 71 has the aforedescribed rotary shaft 71*a*, an attachment surface 71*b* for the connector member 70, and a connecting portion 71*c* extending to the inner side plate 40 of the apparatus main body 14 at a location on the back of the attachment surface 71*b* which is separated from the rotary shaft 71*a*. An auxiliary shaft 71*e* disposed coaxially with the rotary shaft 71*a* and a side plate portion 71*d* formed with a slot 71*f* are integrally formed on the distal end of the connecting portion 71*c*. The auxiliary shaft 71*e* is fitted in a hole 40*m* formed in the inner side plate 40 and is rotatably and axially movably supported by the hole 40*m*. On the back of the attachment surface 71*b*, there is an attachment portion 71*g* for the compression coil spring 74. Further, a positioning rib 71*h* vertically extends from a side of the attachment surface 71*b* to which the connector member 70 is attached. This positioning rib 71*h* is fitted in the aforementioned slit 11*f* provided in the process cartridge B (FIG. 3).

As shown in FIG. 9, the housing 72 is attached to an optical plate if, and pivotally supports the connector holder 71 having the connector member 70 fixed thereto in the apparatus main body 14. The optical plate if is a housing supporting the optical system 1, and this housing is fixed to the apparatus main body 14. The housing 72 is of a shape in which a side plate 72*b* formed with a supporting portion 72*a* pivotally supporting the connector holder 71 is connected to a top surface portion 72*c* by a rear surface portion 72*d*. The rotary shaft 71*a* of the connector holder 71 is rotatably and axially movably fitted to the supporting portion 72*a*. The spacing between the right and left side plates 72*b* is wider than the lengthwise width of the connector holder 71, and the connector holder 71 can slide also toward the rotary shaft between the side plates 72*b*. The connector holder 71 is made slidable in the lengthwise direction (toward the rotary shaft) and the connector holder 71 is lengthwisely positioned in the slit 11*f* of the process cartridge B by the positioning rib 71*h*, whereby the electrical contact 70*a* of the connector member 70 can be lengthwisely accurately positioned on the contact portion 60*b* of the tag chip 60. Consequently, reliability is improved and also, the width of the contact portion 60*b* of the tag chip 60 can be reduced. The top surface portion 72*c* is provided with a hole 72*e* for passing therethrough a lead wire (not shown) connected to the electrical contact 70*a* of the connector member 70 and a receiving surface for the compression coil spring 74.

The link 73 has a first shaft 73*a* passing through a through-hole 40*n* formed in the left inner side plate 40 and fitted in the slot 71*f* of the connector holder 71, and a second shaft 73*b* fitted in the fitting hole 52*d* of the moving member 52. Thus, there is constituted a four-node link mechanism connecting the connector holder 71 and the moving member 52 together and having the moving member 52 as a driving node.

The moving member 52, as previously described, is biased in such a direction that the boss 52*c* faces upwardly by the action of the torsion coil spring 53. The biasing force imparted to the connector holder 71 by this torsion coil spring 53 is greater than the pressure force of the compression coil spring 74, and pushes up the connector holder 71 against the pressure force of the compression coil spring 74 when the moving member 52 is being upwardly biased. Therefore, the first shaft 73*a* of the link 73 abuts against the upper end of the slot 71*f* of the connector holder 71. The connector holder 71 receives a force in a direction opposite to the pressing direction of the compression coil spring 74 by the link 73 at a location lengthwisely separate from the pressing plate by the compression coil spring 74 and therefore, in order to suppress the deformation of the connecting portion 71*c* thereby, the aforedescribed auxiliary shaft 71*e* is received in the hole 40*m* of the inner side plate 40.

Mounting of the Process Cartridge Onto the Main Body

Figure 10:
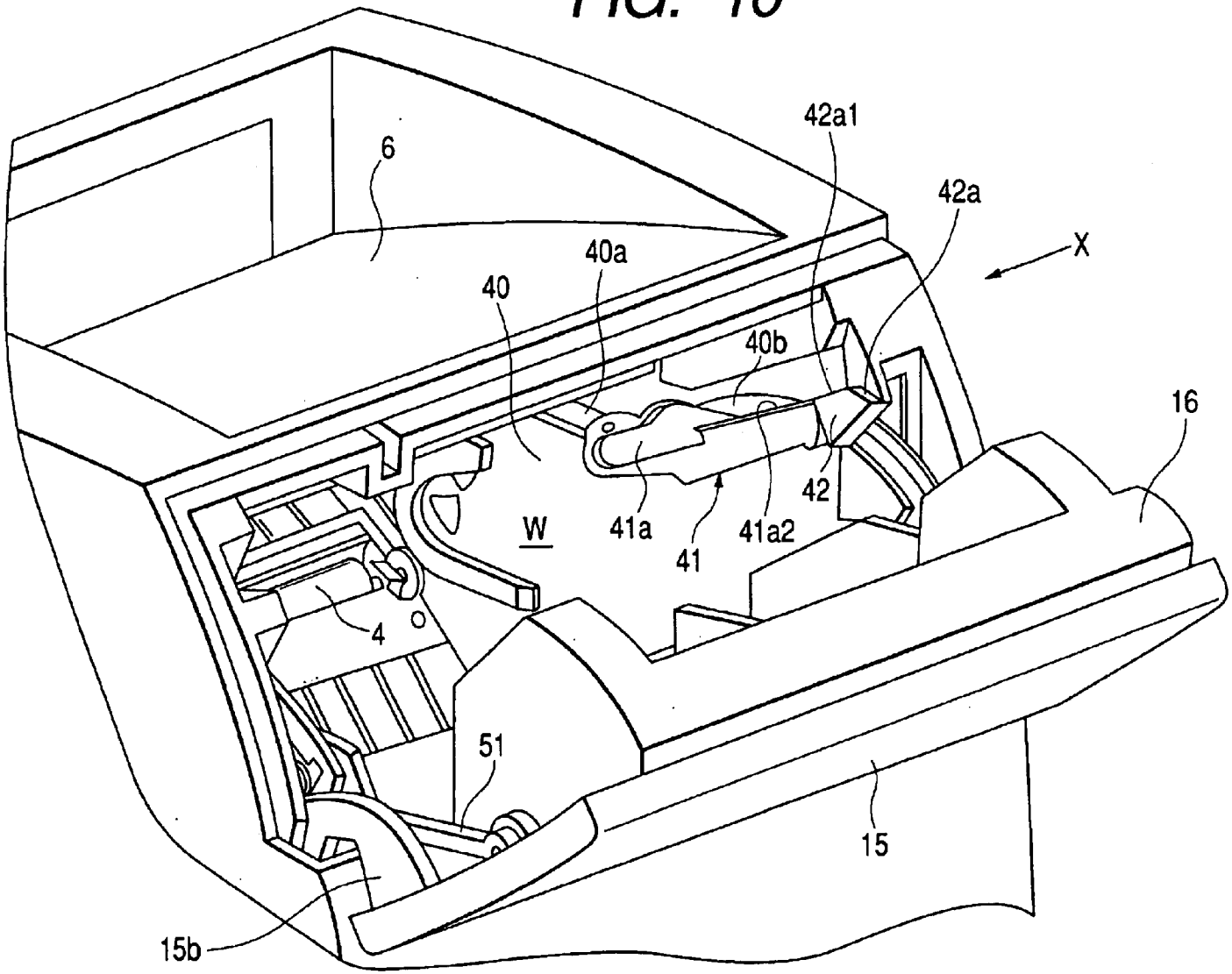
FIG. 10 is a perspective view of the interior of the image forming apparatus as it is seen through an insertion port for the process cartridge with the openable and closable cover fully opened.
Figure 12:
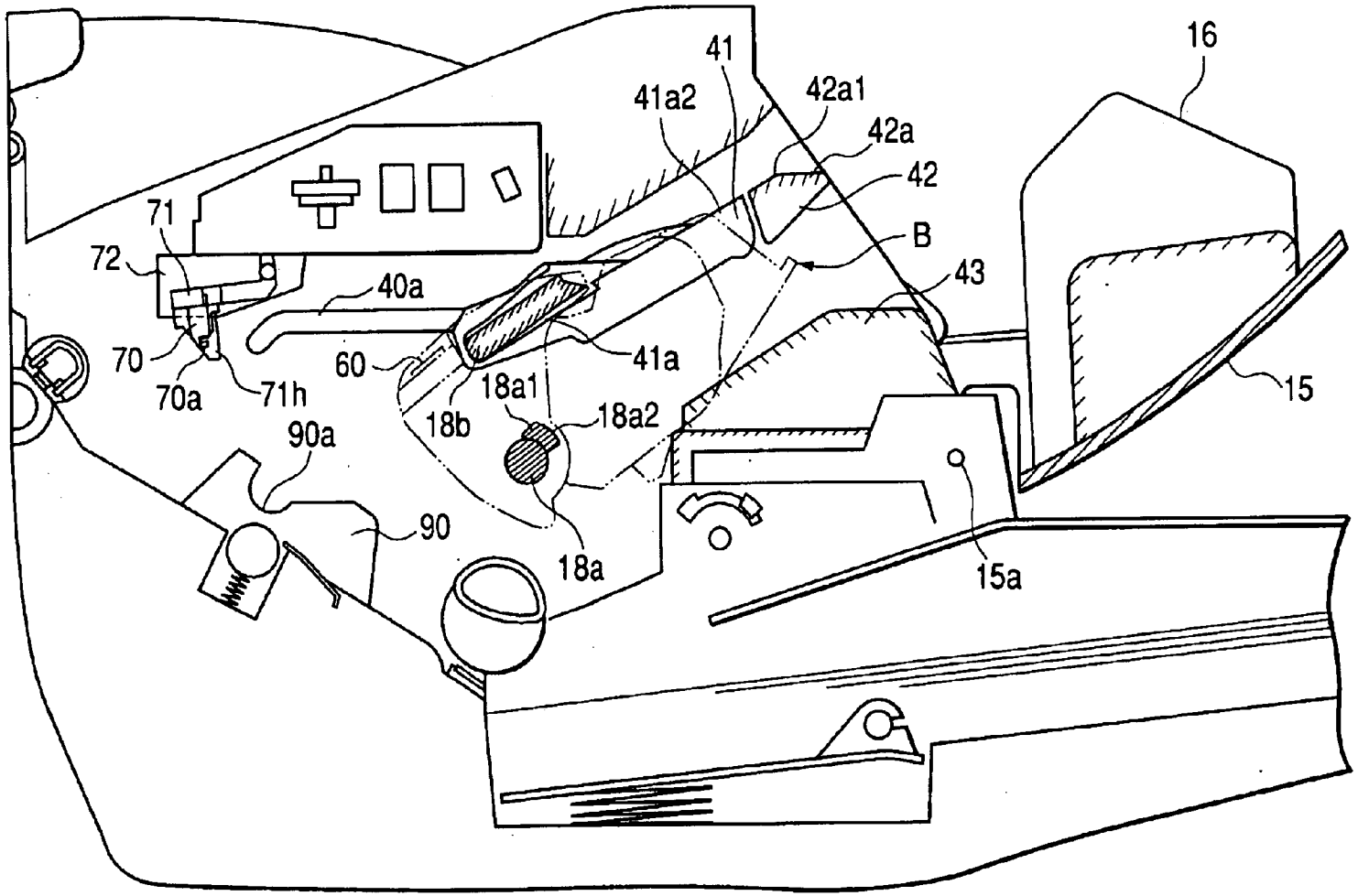
FIG. 12 is a longitudinal cross-sectional view of the apparatus main body showing the states of the insertion course and the taking-out course of the process cartridge with the openable and closable cover fully opened.

Reference is now had to FIGS. 10 to 12 to describe the operation of mounting and dismounting the process cartridge with respect to the image forming apparatus A having a process cartridge mounting and dismounting mechanism by an operator's hand.

When the openable and closable cover 15 of the image forming apparatus A is fully opened (the opening position of the openable and closable cover), there appears an opening W for mounting and dismounting the process cartridge. In the opened state, as shown in FIG. 10, the moving guide 41 appears in a posture in which it is lowered toward the inner part in the insertion direction of the process cartridge B. Upstream of the moving guide 41 with respect to the insertion direction, an auxiliary guide 42 is symmetrically fixed to the inner side plate 40 at right and left.

In the present embodiment, the moving guide 41 is designed to move in operative association with the opening and closing operation of the openable and closable cover 15. Therefore, if the rear end of the moving guide 41 (the end surface thereof adjacent to the openable and closable cover) is designed to be capable of being pushed by the process cartridge B, the moving guide 41 will escape into the interior of the image forming apparatus A, and it will become difficult for the mounting guide 18*b* of the process cartridge B to be put into the guide groove 41*a* of the moving guide 41. Therefore, in the present embodiment, the auxiliary guide 42 fixed to the inner side plate 40 and having a front guide surface 42*a*1 connected to the rear end of the guide surface 41*a*2 of the moving guide 41 is provided upstream of the moving guide 41 with respect to the mounting direction (arrow X) of the process cartridge B. The auxiliary guide 42 is provided with a mounting and dismounting auxiliary portion 42*a* in continuation to the front guide surface 42*a*1 on the upstream side with respect to the insertion direction of the process cartridge B. The mounting and dismounting auxiliary portion 42*a* is a substantially horizontal surface.

As shown in FIG. 11, the mounting guide 18*b* of the process cartridge B is placed on this mounting and dismounting auxiliary portion 42*a*, and as shown in FIG. 12 the process cartridge B is inserted until the mounting guide 18*b* strikes against the inner part of the guide groove 41*a* of the moving guide 41. At this time, the process cartridge B has nothing that resists the insertion thereof, and the insertion direction is downwardly inclined and therefore, the mounting guide 18*b* can naturally strike against the inner part of the guide groove 41*a* by the gravity of the process cartridge B (FIG. 12). Here, the lengthwise position of the process cartridge B relative to the apparatus main body 14 is regulated by the right and left moving guides 41, and the insertion of the process cartridge B into the apparatus main body 14 progresses into the apparatus main body 14 without moving to the right and left.

Description of the Operation of the Process Cartridge Mounting and Dismounting Mechanism Movement of the Moving Guide and Sliding of the Connector Holder Operatively Associated with the Openable and Closable Cover Reference is now had to FIGS. 13 to 19 to describe the manner in which the moving guide 41 having the process cartridge B placed thereon is moved in the first half of the closing operation of the openable and closable cover 15.

When the openable and closable cover 15 is being closed with rotating about the central boss 15*a* from the opening position, as shown in FIGS. 14 to 19, the cam plate 50 which is the follower of the four-node link mechanism connected to the openable and closable cover 15 by the connecting plate 51 is also rotated. Therefore, the second boss 41*c* of the moving guide 41 is moved along the arcuate portion 40*b*1 of the second guide rail 40*b* on the distal end side of the straight groove hole 50*b*2 of the cam groove 50*b* which is a first cam portion formed on the cam plate 50.

The arcuate portion 40*b*1 has the rotary shaft 50*a* of the cam plate 50 as its center, and the radius thereof is equal to the distance from the rotary shaft 50*a* of the cam plate 50 to the straight groove hole 50*b*2 of the cam groove 50*b*. Consequently, the second boss 41*c* of the moving guide 41 is held by arcuate portion 40*b*1 of the second guide rail 40*b* and the straight groove hole 50*b*2, and is moved with the rotation of the cam plate 50. Accordingly, the first boss 41*b* of the moving guide 41 is also moved to the inner part side in the mounting direction of the process cartridge B along the horizontal portion 40*a*1 of the first guide rail 40*a*.

Figure 16:
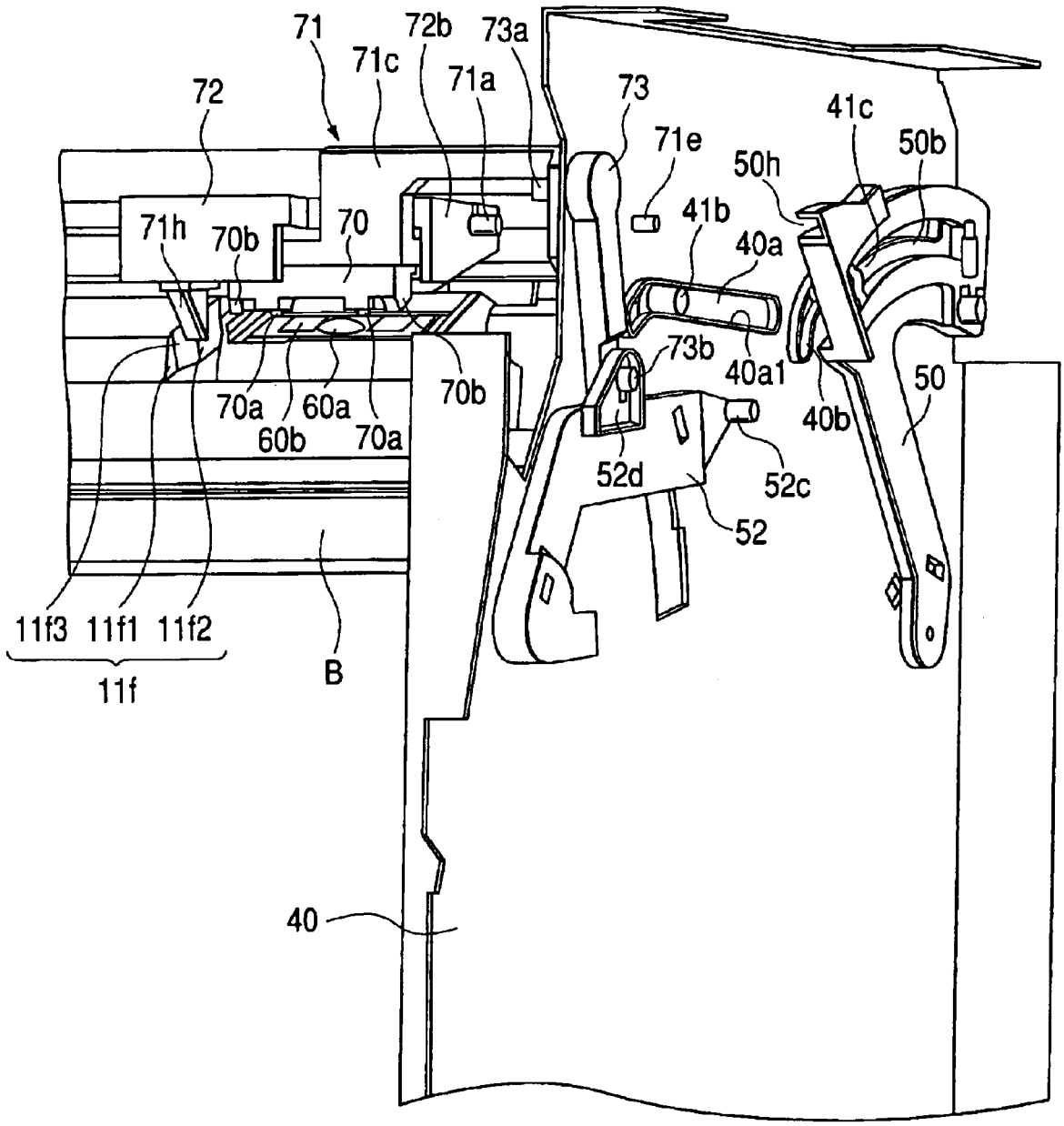
FIG. 16 is a perspective view showing the positional relationship between a positioning rib and a slit in a state in which the openable and closable cover has been further moved from the state of FIG. 13.
Figure 17:
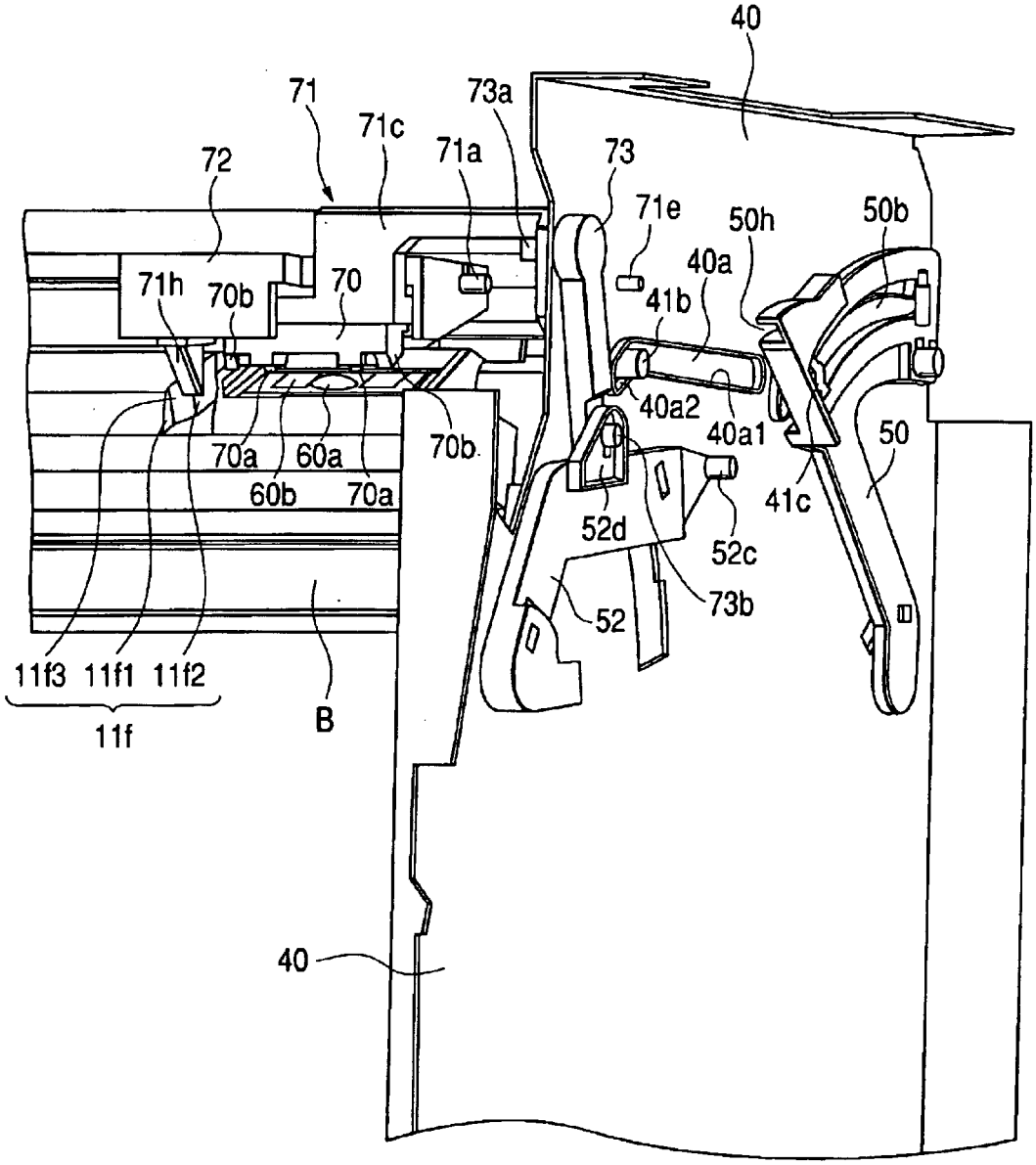
FIG. 17 is a perspective view showing the positional relationship between the positioning rib and the slit in a state in which the openable and closable cover has been further moved and the moving guide has reached the deepest portion.

When the process cartridge B is transported to the inner part of the apparatus main body 14, as shown in FIG. 15, the introduction portion 11*f*1 of the slit 11*f* arrives at the positioning rib 71*h* of the connector holder 71. This introduction portion 11*f*1 is made wide to receive the positioning rib 71*h* of the connector holder 71 therein when the process cartridge B is transported thereto. Thereby, when the process cartridge B is transported thereto, as shown in FIG. 16, the positioning rib 71*h* contacts with the inclined portion 11*f*3 of the slit 11*f* and the connector holder 71 begins to move in the lengthwise direction thereof. Then, as shown in FIG. 17, the positioning rib 71*h* is fitted to the thrust guide portion 11*f*2 near an area in which the first boss 41*b* of the moving guide 41 shifts to the inclined portion 40*a*2 of the first guide rail 40*a*, and the connector holder 71 to which the connector member 70 is fixed has its lengthwise position adjusted to the process cartridge B.

During the transport of this process cartridge B, the connector holder 71 is in a standby position (a position in which the electrical contact 70*a* and the contact portion 60*b* are spaced apart from each other) in which it is raised up by the action of the torsion coil spring 53 secured to the moving member 52 and therefore, the electrical contact 70*a* of the connector member 70 contacts with no part of the process cartridge B.

Description will now be made of the movement of the cam plate 50 and the moving guide 41 by the rotation of the openable and closable cover 15 at this time. At a point of time immediately before the termination of the transport of the process cartridge B (FIG. 17 showing the course of the shift from a state shown in FIG. 14 to a state shown in FIG. 19), the second boss 41*c* of the moving guide 41 is positioned at a portion which smoothly connects the arcuate portion 40*b*1 and straight portion 40*b*2 of the second guide rail 40*b* of the inner side plate 40. The first boss 41*b* is at a position overhanging the inclined portion 40*a*2 of the first guide rail 40*a* of the inner side plate 40. Thereafter, the area surrounded by the cam groove 50*b* of the cam plate 50 and the second guide rail 40*b* of the inner side plate 40 becomes a portion of the radially inner side of the straight groove hole 50*b*2 of the cam groove 50*b* and the straight portion 40*b*2 of the second guide rail 40*b*, and the second boss 41*c* of the moving guide 41 is moved in the area surrounded by these two. At this time, the moving guide 41 sends the first boss 41*b* below the inclined portion 40*a*2 and at the same time, the second boss 41*c* is moved to the lower end of the straight portion 40*b*2, and the second boss 41*c* abuts the lower end of the straight portion 40*b*2, whereupon the movement of the moving guide 41 is terminated (FIG. 19).

Figure 19:
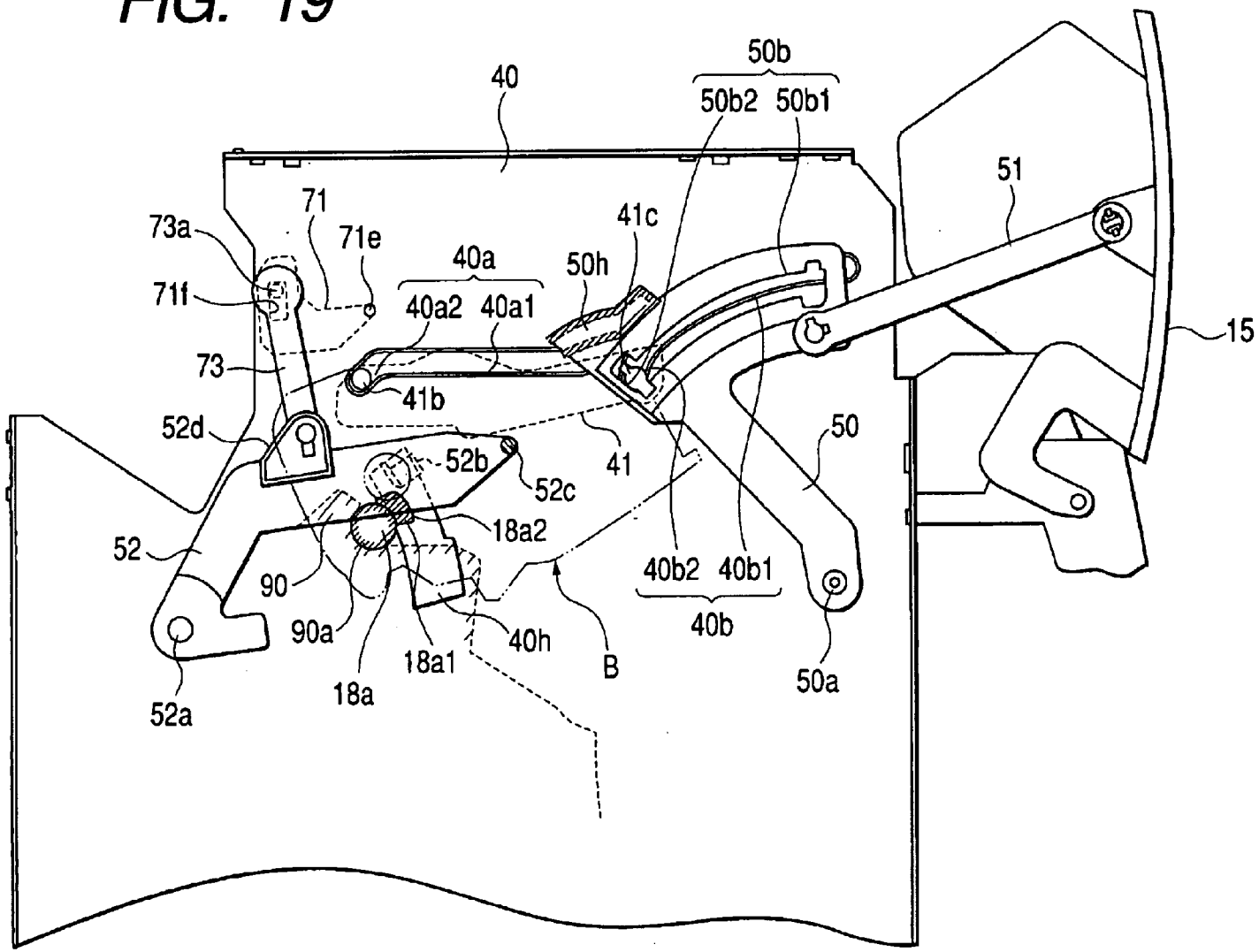
FIG. 19 is a longitudinal cross-sectional view of the apparatus main body showing the position of each link of the link mechanism in the state of FIG. 17.

Left Positioning Means of the Process Cartridge and Driving of the Movable Connector Mechanism In the transport of the process cartridge B resulting from the movement of the moving guide 41 operatively associated with the rotation of the openable and closable cover 15, as shown in FIG. 19, the positioning member 18*a* does not completely come into a positioning portion 90*a* provided in the transport frame 90. This is because the process cartridge B is pushed up by the abutting forces of the transferring roller 4 and the various electrical contacts and the positioning guide 18*a* is not completely engaged with the positioning portion 90*a* (FIG. 23 which is an enlarged view of the biasing portion). Therefore, on the outer side of the inner side plate 40, there is provided the moving member 52 driven by the cam plate 50 which is the positioning means of the process cartridge B. The moving member 52 has a biasing portion 52*b* pivotally supported in a rotary hole 40*g* provided at a location separate from the positioning portion 90*a* and coming from the sector hole 40*h* of the left inner side plate 40 into the interior of the inner side plate 40. The moving member 52 provides a driving node for the connector mechanism and drives the movable connector mechanism.

Figure 21:
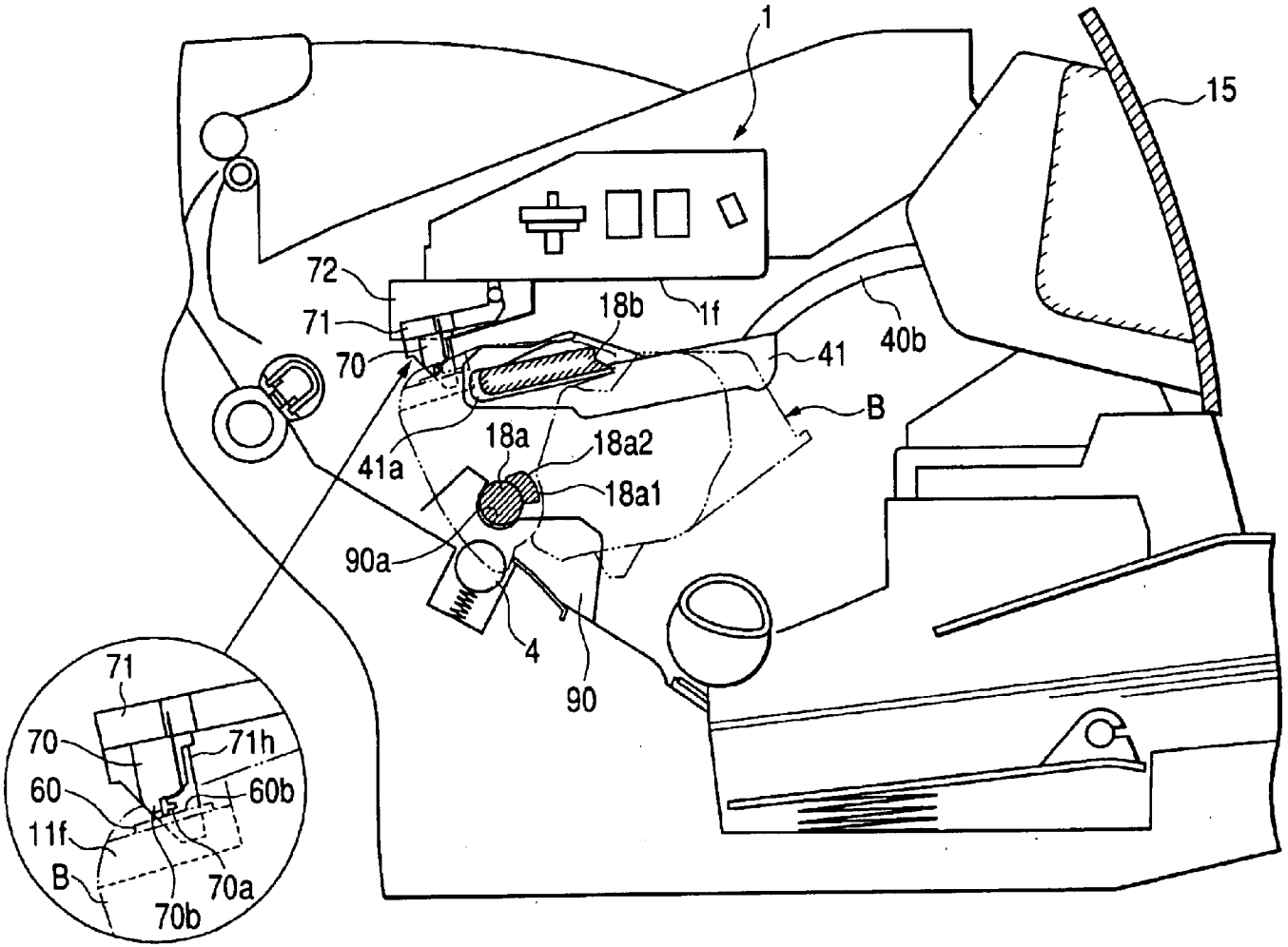
FIG. 21 is a longitudinal cross-sectional view of the apparatus main body showing the positioning means of the process cartridge and the movable connector mechanism in the state of FIG. 20.

The moving member 52, as shown in FIGS. 14 and 19, has its biasing portion 52*b* biased counter-clockwisely about the pivot shaft 52*a* by the torsion coil spring 53 and abutting the upper end of the sector hole 40*h* during the transport of the process cartridge B. Consequently, it is in its retracted position in which it does not go into the movement loci of the positioning guide 18*a* and the portion 18*a*1 to be biased, and does not affect the transport of the process cartridge B. In the state shown in FIG. 19, that is, when the openable and closable cover 15 is further closed after the movement of the moving guide 41 has been terminated, as shown in FIG. 20, the arm driving portion 50*h*1 of the second cam 50*h* of the cam plate 50 takes in the boss 52*c* of the moving member 52, and the moving member 52 begins to rotate against the force of the torsion coil spring 53. Thereupon, the connector holder 71 connected to the moving member 52 by the link 73 and downwardly biased by the compression coil spring 74 also begins to rotate downwardly toward the process cartridge B. Then, as shown in FIG. 21, the electrical contact 70*a* contacts the contact portion 60*b* of the tag chip 60 (FIGS. 3 and 9).

As shown in FIG. 17, the lengthwisely movable connector holder 71 has its positioning rib 71*h* fitted to the thrust guide portion 11*f*2 of the process cartridge B and is lengthwisely aligned with the process cartridge B. Consequently, the electrical contact 70*a* of the connector member 70 reliably contacts with the contact portion 60*b* of the tag chip 60.

Figure 22:
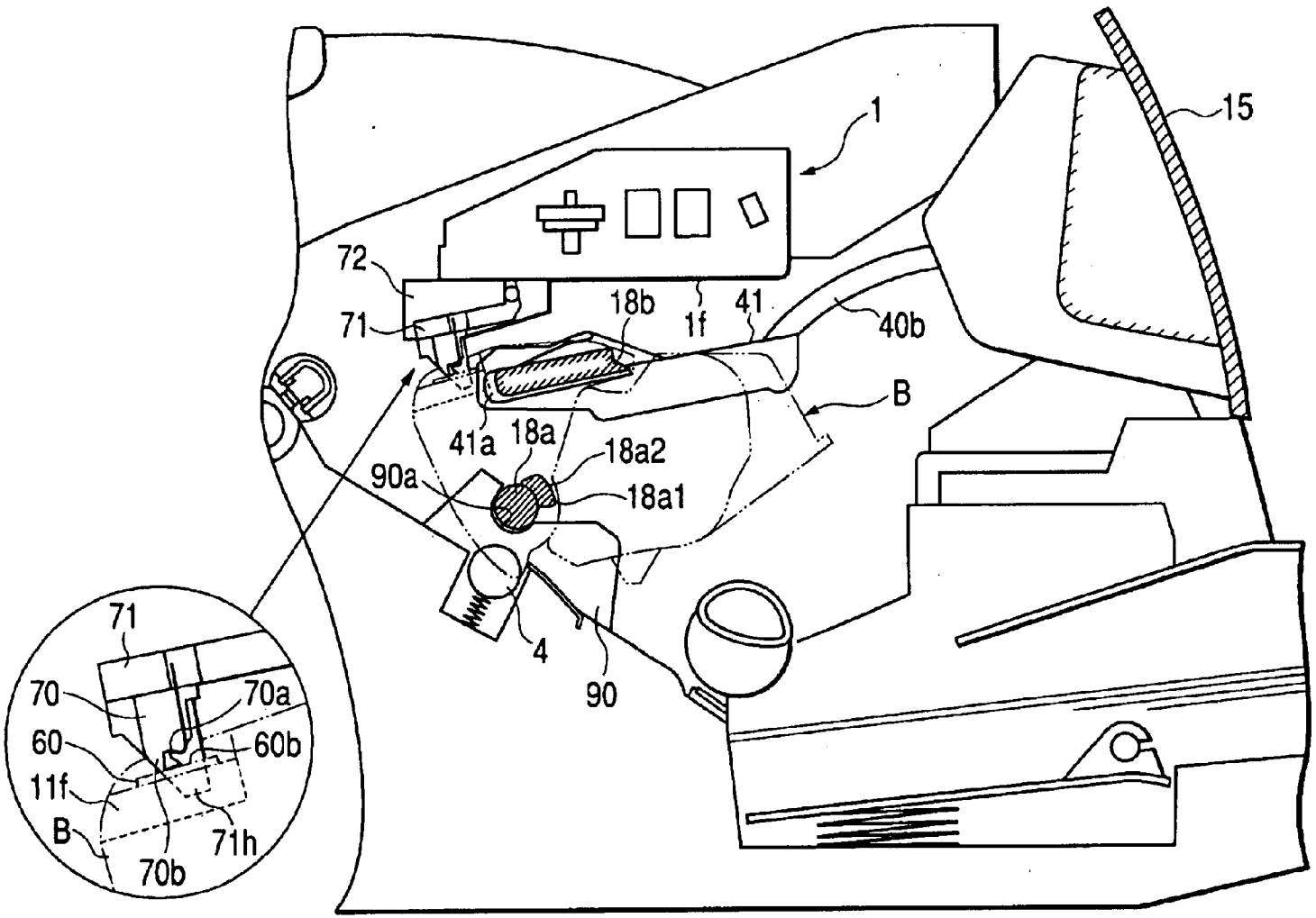
FIG. 22 is a longitudinal cross-sectional view of the apparatus main body showing the positioning means of the process cartridge and the movable connector mechanism in the further movement of the openable and closable cover from the state of FIG. 21.

Thereafter, as shown in the enlarged view of FIG. 22, the dashing portion 70*b* of the connector member 70 contacts with the surface of the tag chip 60 and the distance in the dashing direction between the connector member 70 and the tag chip 60 is determined. The electrical contact 70*a* of the connector member 70 is elastically deformed to thereby generate abutting pressure and therefore, the two are dashed against each other and the amount of resilient deformation of the electrical contact 70*a* is controlled, thereby suppressing the unevenness of the abutting pressure of the electrical contact 70*a* and securing stable electrical conduction. Here, the compression coil spring 74 which downwardly biases the connector holder 71 is for preventing the connector holder 71 from floating up by the contact reaction force of the electrical contact 70*a* to the tag chip 60, and is set so as to generate a moment greater than the moment generated by the abutting force of the electrical contact 70*a* in a state in which the dashing portion 70*b* of the connector member 70 abuts against the tag chip 60. When the dashing portion 70*b* of the connector member 70 abuts against the surface of the tag chip 60, the connector holder 71 is stopped.

Figure 23:
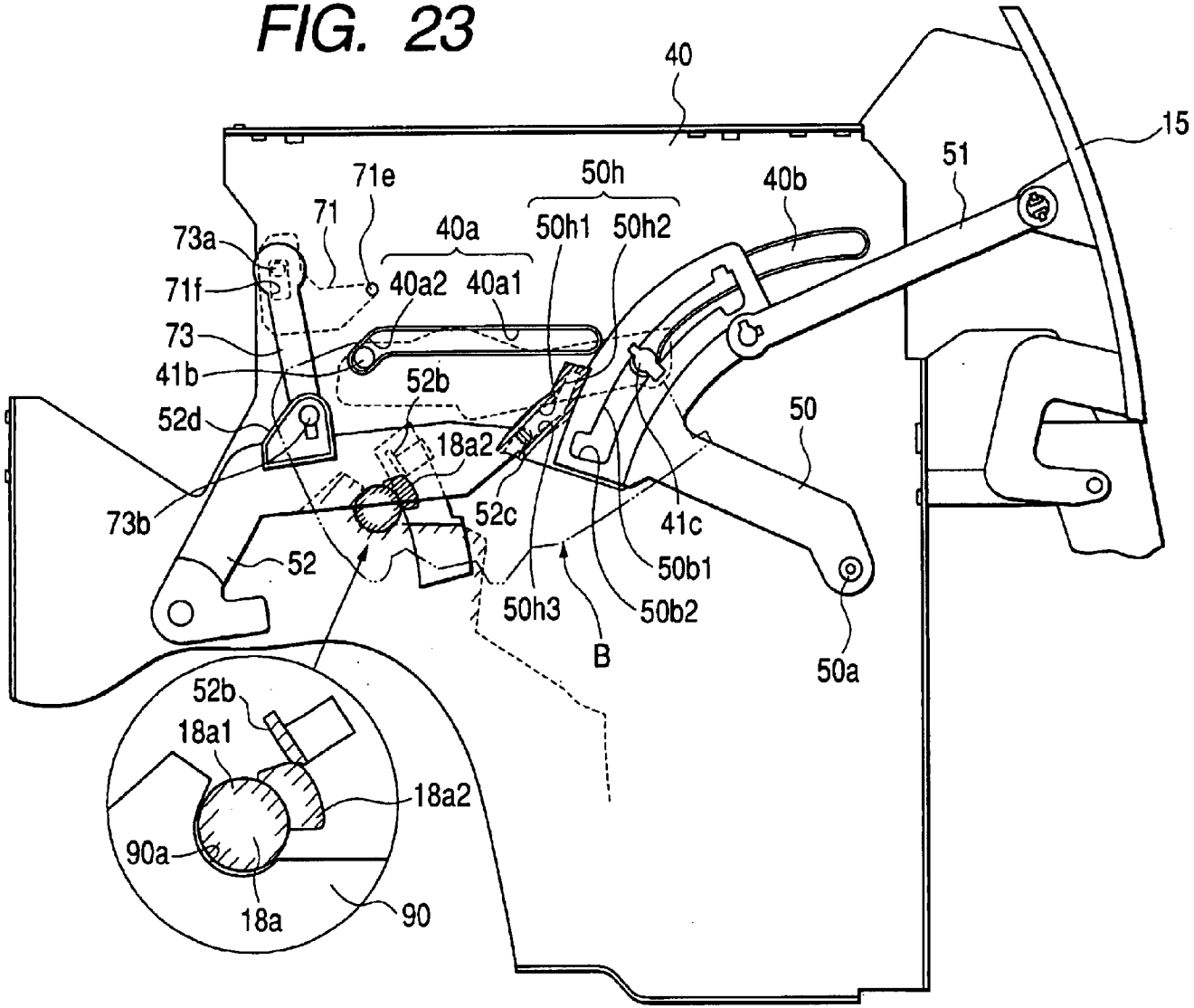
FIG. 23 is a longitudinal cross-sectional view of the apparatus main body showing the position of each link of the link mechanism in the state of FIG. 22.

As shown in FIG. 23, the first shaft 73*a* of the link 73 is connected to the slot 71*f* of the connector holder 71 and therefore, after the connector holder 71 has been stopped, the first shaft 73*a* of the link 73 moves in the slot 71*f* and therefore, the moving member 52 can continue to rotate still after the connector holder 71 has been stopped. In that rotation, the biasing portion 52*b* contacts with the portion 18*a*1 to be biased of the positioning member 18*a* (FIG. 23 which is an enlarged view of the biasing portion), and pushes the positioning member 18*a* into the positioning portion 90*a* (see FIG. 24 which is an enlarged view of the biasing portion). At this time, there are chambers 18*a*3 and 52*b*1 on the outer peripheral surface 18*a*2 of the portion to be biased and the biasing portion 52*b*, respectively, and the biasing portion 52*b* can smoothly slide onto the outer peripheral surface 18*a*2 of the portion to be biased of the positioning member 18*a*. By this operation, the process cartridge B is slightly moved in the mounting direction and therefore, the contact portion 60*b* of the tag chip 60 moves while being in contact with the electrical contact 70*a* of the connector member 70, and the contact surface is wiped. Even if foreign substances such as dust and stains adhere to the contact portion 60*b*, these foreign substances are wiped off from the contact portion 60*b* and therefore, stable electrical conduction can be obtained. When the first shaft 73*a* of the link 73 separates from the upper end of the slot 71*f*, the connector holder 71 no longer receives the force from the moving member 52 and therefore, the connector holder 71 is urged against the process cartridge B by the difference between the moments by the compression coil spring 74 and the electrical contact 70*a*.

Figure 24:
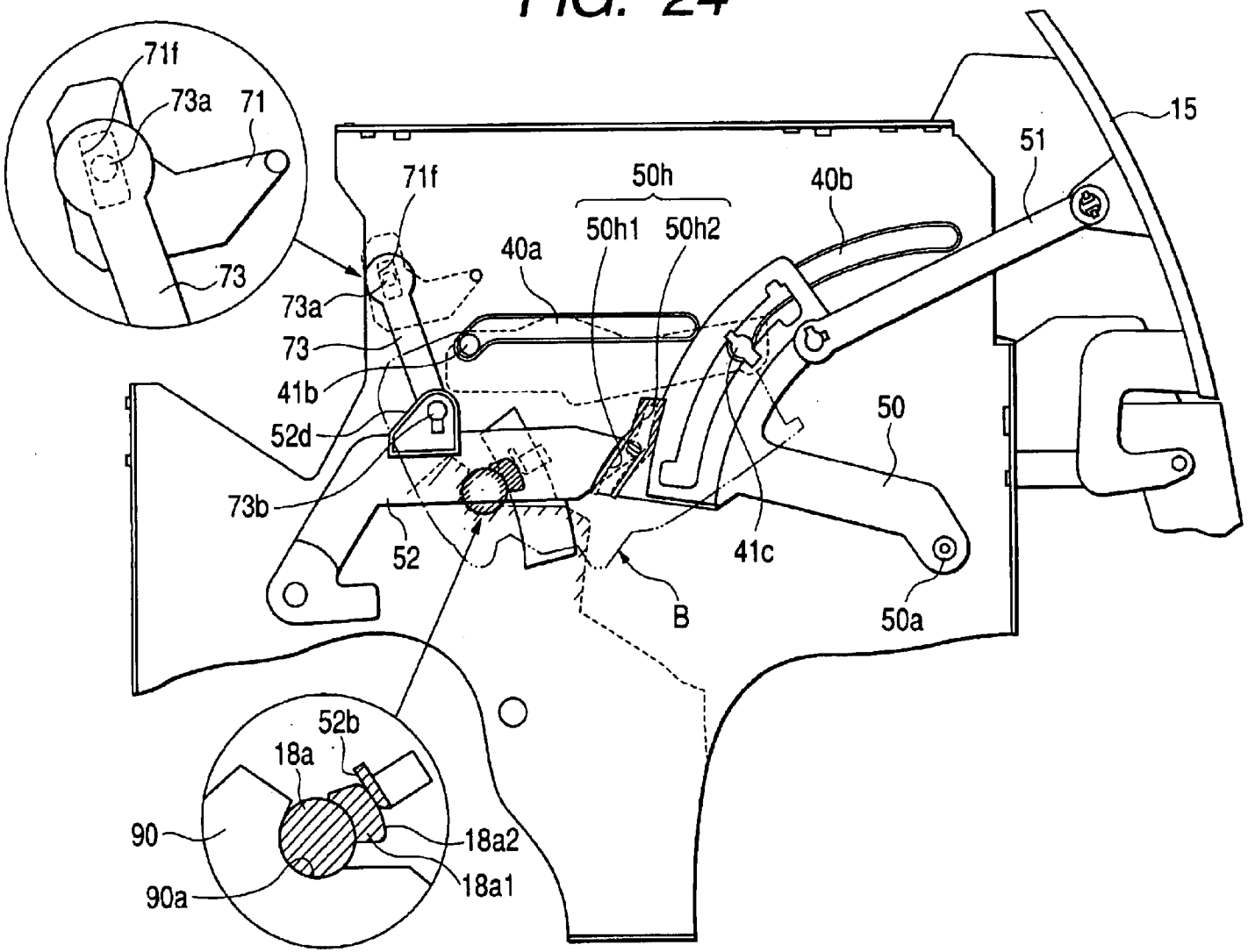
FIG. 24 is a longitudinal cross-sectional view of the apparatus main body showing the position of each link of the link mechanism in the further movement of the openable and closable cover from the state of FIG. 23.
Figure 25:
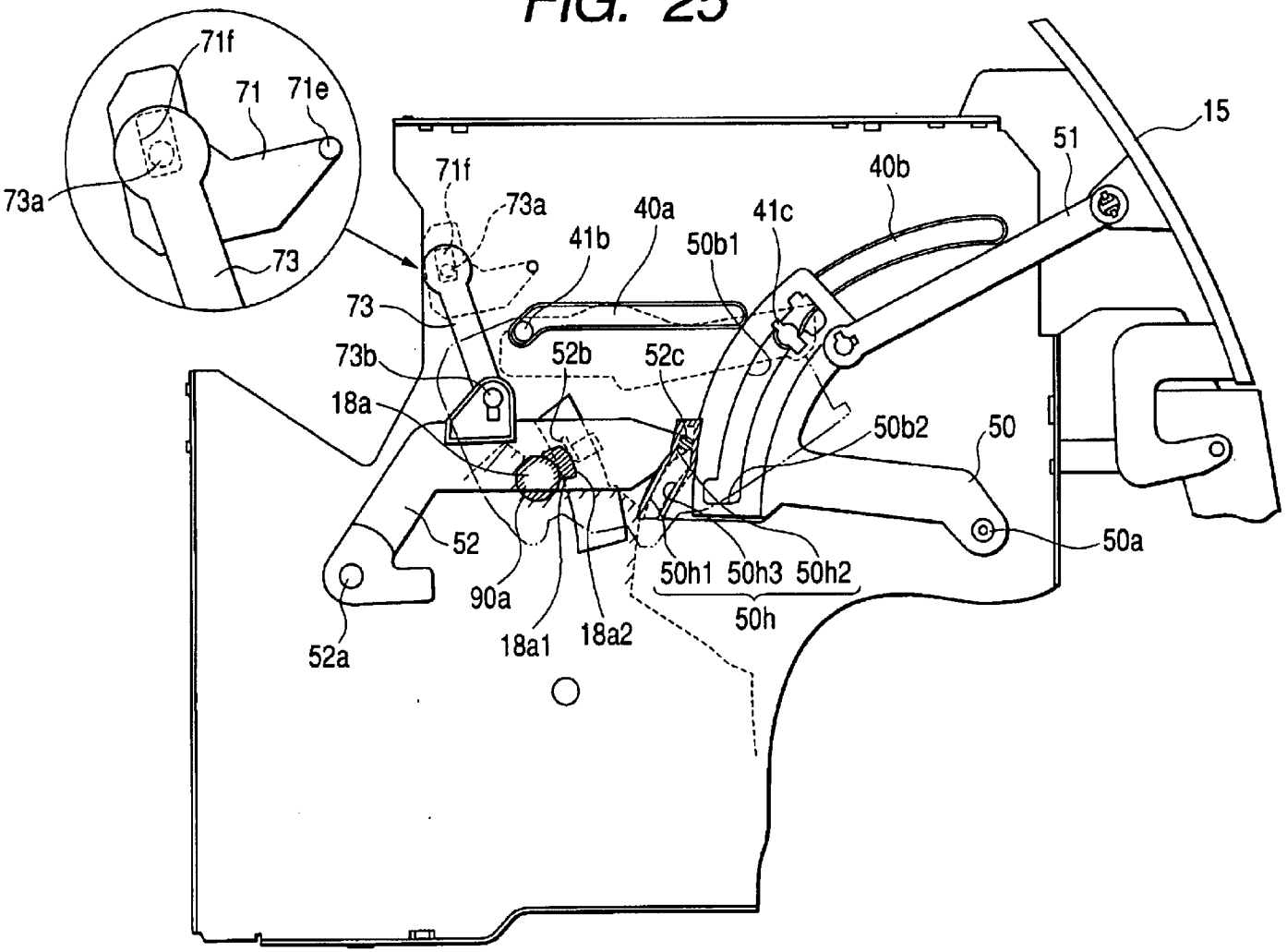
FIG. 25 is a longitudinal cross-sectional view of the apparatus main body showing the position of each link of the link mechanism in a state in which the openable and closable cover is completely closed.

As shown in FIG. 24, the moving member 52 still rotates after the biasing portion 52*b* contacts with the portion 18*a*1 to be biased of the process cartridge B and pushes the positioning member 18*a* into the positioning portion 90*a*, and comes to the outer peripheral surface 18*a*2 of the portion to be biased which is a holding position in which the biasing portion 52*b* has completely come into the movement locus of the portion 18*a*1 to be biased. When this state is brought about, the biasing portion 52*b* holds down the portion 18*a*1 to be biased, and makes it impossible for the positioning member 18*a* to be spaced apart from the positioning portion 90*a* and therefore, it never happens that the positioning member 18*a* is spaced apart from the positioning portion 90*a* by such an extraneous force acting on the process cartridge B as the force with which the recording medium 2 tends to raise the photosensitive drum 7 during the image forming operation, in addition to the abutting forces of the transferring roller 4 and the electrical contact 70*a*. When as shown in FIG. 25, the moving member 52 comes to a holding position for immovably holding the positioning member 18*a*, the boss 52*c* goes through the arm driving portion 50*h*1 of the second cam 50*h* of the cam plate 50 and shifts to an arm holding portion 50*h*2 arcuately formed about the rotation axis of the cam plate 50. Consequently, the rotation of the moving member 52 is stopped. The cam plate 50 is further rotated and in a position in which the boss 52*c* of the moving member 52 has been reliably shifted to the cam surface of the arm holding portion 50*h*2, the openable and closable cover 15 shown in FIGS. 1 and 25 assumes a completely closed posture (closing position).

The abutting relation between the boss 52*c* of the moving member 52 and the second cam 50*h* of the cam plate 50 in the completely closed state (closing position) of the openable and closable cover 15 is such that the boss 52*c* is received by the arm holding portion 50*h*2 of the second cam 50*h* which is arcuately formed about the center of the rotary shaft 50*a* of the cam plate and therefore, even if the torsion coil spring 53 tends to rotate the moving member 52 toward its retracted position (counter-clockwisely in FIG. 25), the cam plate 50 is in its unrotatable state. Accordingly, the openable and closable cover 15 is not opened and the image forming apparatus A is not hindered.

Opening Operation of the Openable and Closable Cover

Description will now be made of the operation of opening the openable and closable cover 15 and of releasing the moving member 52 and the connector mechanism, and thereafter, of moving the moving guide 41 to thereby take out the process cartridge B from the moving guide 41. This conversely follows the operation hitherto described.

When the openable and closable cover 15 is opened from its state shown in FIG. 25, the cam plate 50 completed thereto by the connecting plate 51 is rotated and the boss 52*c* of the moving member 52 shifts from the arm holding portion 50*h*2 of the second cam 50*h* to the arm driving portion 50*h*1 thereof. Thereupon the biasing portion 52*b* of the moving member 52 is disengaged from the portion 18*a*1 to be biased of the process cartridge B by the spring pressure of the torsion coil spring 53 secured to the pivot shaft 52*a* of the moving member 52. Even when the frictional force between the biasing portion 52*b* and the portion 18*a*1 to be biased is great and the moving member 52 is not raised, the inner surface 50*h*3 contacts with the boss 52*c* in the radial direction of the armdriving portion 50*h*1 of the second cam 50*h* of the cam plate 50, and the cam plate 50 is rotated to thereby forcibly raise the moving member 52 and therefore, the moving member 52 can be reliably moved to its retracted position.

When the moving member 52 is raised, as shown in FIG. 23, the first shaft 73*a* of the link 73 abuts the upper end of the slot 71*f* of the connector holder 71, and raises the connector holder 71 upwardly against the force of the compression coil spring 74 which is depressing the connector holder 71. When the moving member 52 completely comes to its retracted position (FIG. 19), the dashing portion 70*b* and electrical contact 70*a* of the connector member 70 are spaced apart from the tag chip 60 (FIG. 18), and the process cartridge B becomes movable. Here, the moment generated by the torsion coil spring 53 holding the moving member 52 in its retracted position is made greater than the moment generated in the moving member 52 by the spring force of the compression coil spring 74 and therefore, the connector holder 71 can be held in its retracted position by the moving member 52 (FIG. 9).

During the hitherto made description of the opening operation of the openable and closable cover 15, the arc groove hole 50*b*1 of the cam groove 50*b* of the cam plate 50 has passed around the second boss 41*c* of the moving guide 41 and therefore, the moving guide 41 has been at a standstill. When as shown in FIG. 19, the cam plate 50 is rotated and the straight groove hole 50*b*2 comes into contact with the second boss 41*c* of the moving guide 41, the second boss 41*c* of the moving guide 41 is raised to the straight portion 40*b*2 of the second guide rail 40*b* of the inner side plate 40, and the moving guide 41 begins to be moved by the opening operation of the openable and closable cover 15. As shown in FIG. 13, the moving guide 41 abuts against the distal end of the mounting guide 18*b* in the inner part of the guide groove 41*a*, and pulls out the process cartridge B. As shown in FIG. 14, by the opening operation of the openable and closable cover 15, the second boss 41*c* of the moving guide 41 is sandwiched between the arcuate portion 41*b*1 of the second guide rail 40*b* of the inner side plate 40 and the distal end side of the straight groove hole 50*b*2 of the cam groove 50*b* of the cam plate 50, and is moved to the opening W side for mounting and dismounting the process cartridge B therethrough, and therewith, the first boss 41*b* is also moved from the inclined portion 40*a*2 of the first guide rail 40*a* and along the horizontal portion 40*a*1 to thereby transport the process cartridge B to a position at which the user can grasp it (FIG. 12).

When the openable and closable cover 15 assumes a completely opened state (the opening position of the openable and closable cover) and the guide surface 41*a*2 of the guide groove 41*a* of the moving guide 41 and the front guide surface 42*a*1 of the auxiliary guide 42 assume their continued position, the process cartridge B becomes capable of being smoothly taken out of the opening W (FIG. 11). The second boss 41*c* of the moving guide 41 lies at that end portion of the arcuate portion 40*b*1 of the second guide rail 40*b* which is adjacent to the opening W, and regulates the movement of the cam plate 50 in the opening direction. As regards the cam plate 50, the second boss 41*c* linked to the openable and closable cover 15 by the connecting plate 51 provides a stopper for the openable and closable cover 15.

Embodiment 2

Embodiment 2 of the connector mechanism will now be described. In Embodiment 2, portions functionally similar to those in Embodiment 1 are given the same reference characters.

Figure 26:
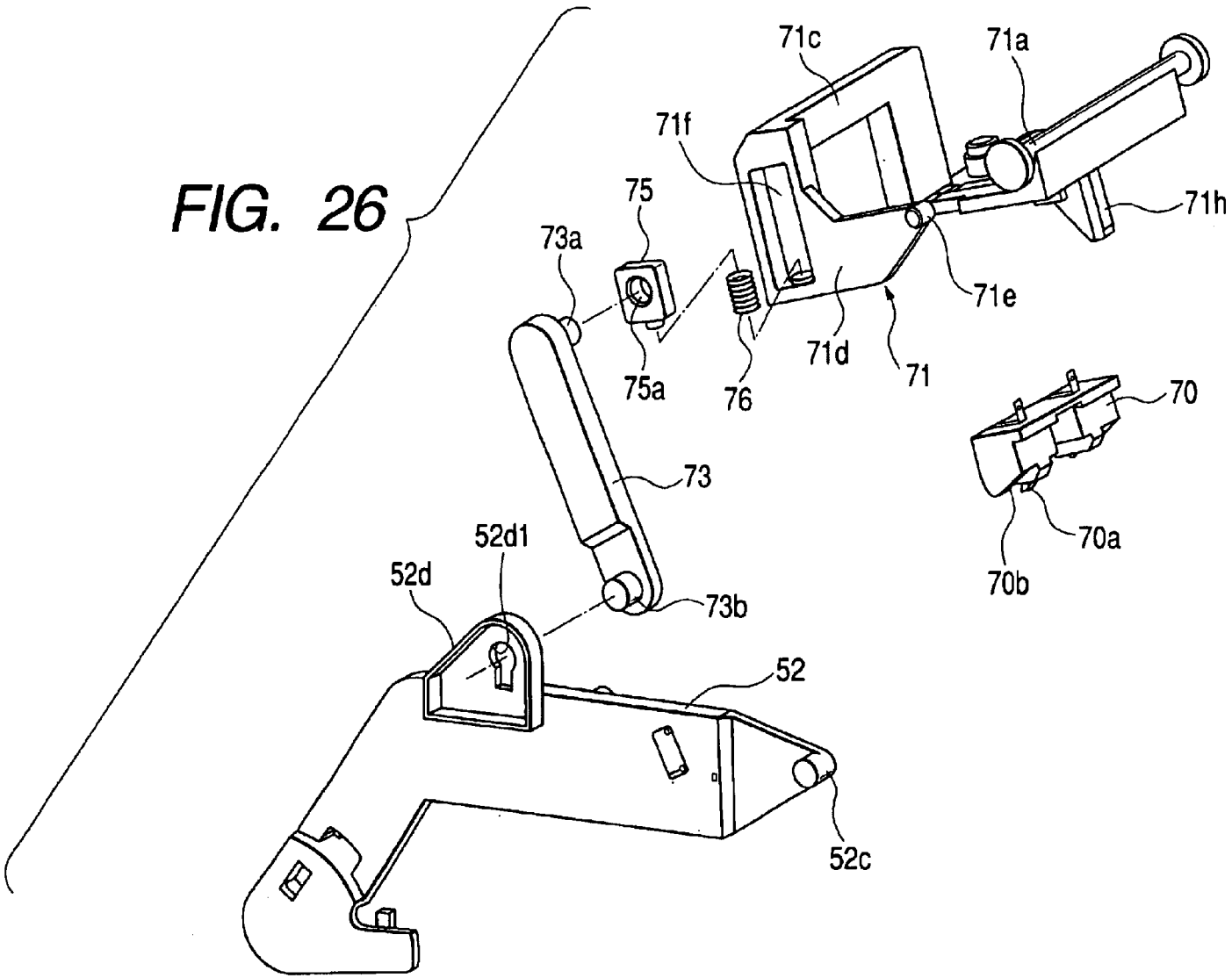
FIG. 26 is a perspective view showing the construction of the members of a movable connector mechanism in Embodiment 2.

As shown in FIG. 26, there is provided a slide frame 75 supported for movement in the slot 71*f* of the connector holder 71 in the direction of the slot. The slide frame 75 is formed with a fitting hole 75*a*, and is connected to the first shaft 73*a* of the link 73. A compression coil spring 76 is disposed between the lower end of the slide frame 75 and the lower end of the slot 71*f* of the connector holder 71. The compression coil spring 76 biases the slide frame 75 toward the upper end of the slot 71*f*. Thus, the slide frame 75 contacts with the upper end of the slot 71*f*.

Figure 27:
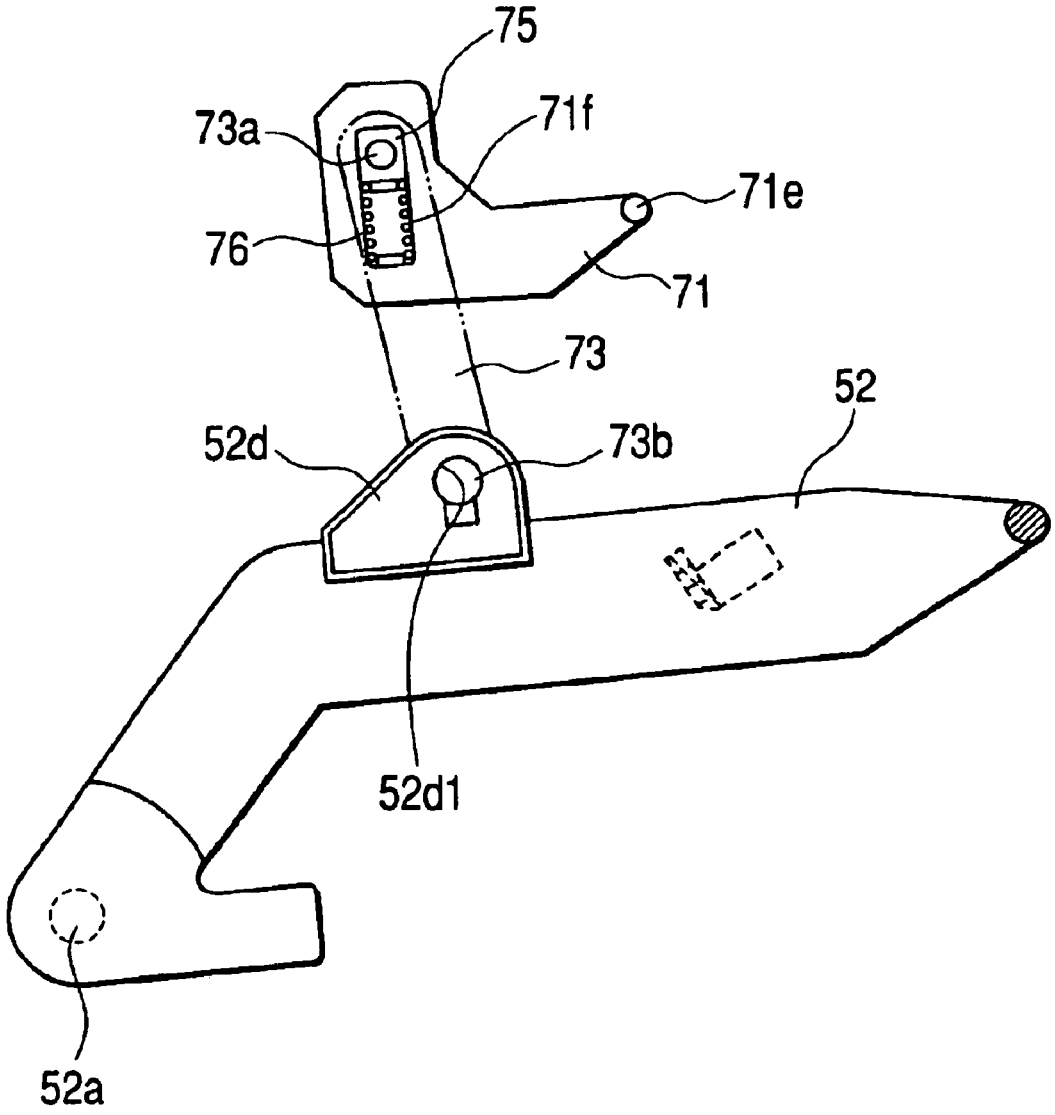
FIG. 27 is a front view showing the acting state of the movable connector mechanism in Embodiment 2.

When as shown in FIG. 27, the moving member 52 is in its retracted position and the slide frame 75 abuts the upper end of the slot 71*f*, the resilient force of the compression coil spring 76 is balanced on the surface of contact between the slide frame 75 and the slot 71*f* and therefore, a downwardly rotating spring force is not acting on the connector holder 71. Thus, the spring force of the torsion coil spring 53 for holding the connector mechanism and the moving member 52 in their retracted positions during the transport of the process cartridge B may be small. Also, the resistance when the positioning rib 71*h* of the connector holder 71 contacts with the inclined portion 11*f*3 of the slit 11*f* provided in the process cartridge B and the connector holder 71 moves in the thrust direction is only the sliding resistance of the fitted portion (FIGS. 9 and 17).

Figure 28:
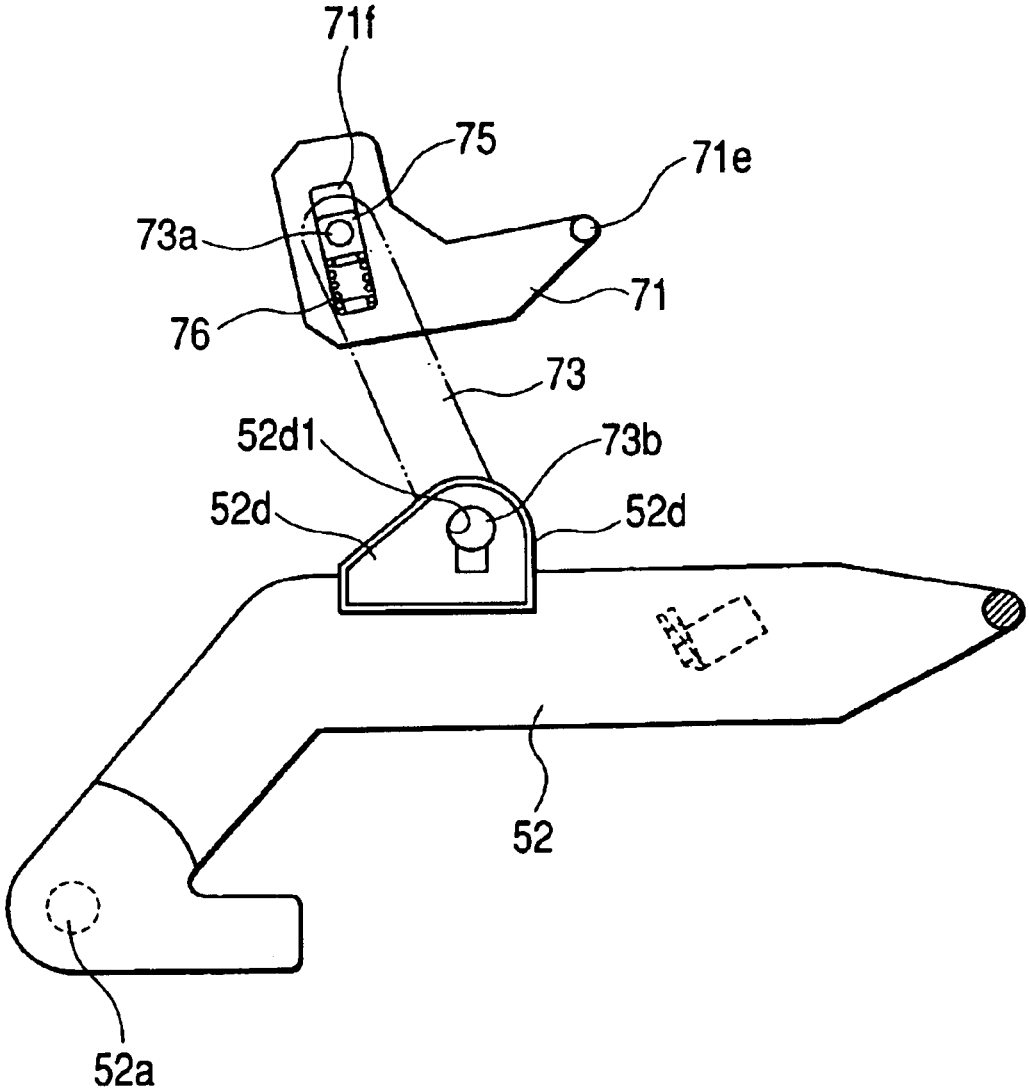
FIG. 28 is a front view showing the acting state of the movable connector mechanism in Embodiment 2.

When as shown in FIG. 28, the moving member 52 is rotated clockwisely about the pivot shaft 52*a* and the connector holder 71 is rotated counter-clockwisely about the auxiliary shaft 71*e* and comes down, the electrical contact 70*a* of the connector member 70 contacts with the tag chip 60 and the movement of the connector holder 71 is stopped (FIGS. 17 and 21 which are enlarged views of the connector member). When the moving member 52 is rotated thereby, as shown in FIG. 28, the first shaft 73*a* of the link 73 causes the slide frame 75 to slide downwardly in the slot 71*f*, and begins to contract the compression coil spring 76. Thereupon, the resilient force of the compression coil spring 76 acts on the lower end of the slot 71*f* of the connector holder 71 to thereby downwardly bias the connector holder 71 and therefore, the electrical contact 70*a* can be resiliently deformed until the dashing portion 70*b* of the connector member 70 abuts against the tag chip 60 (FIG. 22 which is an enlarged view of the connector member).

Figure 29:
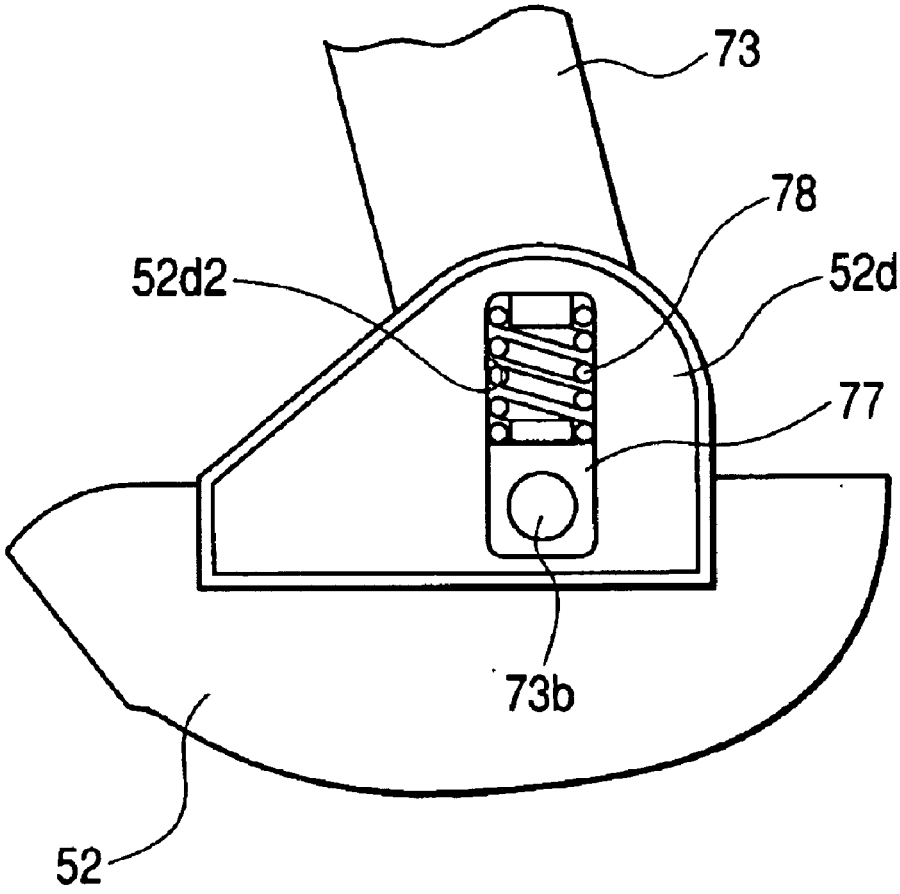
FIG. 29 is a front view showing the construction of a movable connector mechanism in a modification of Embodiment 2.
Figure 30:
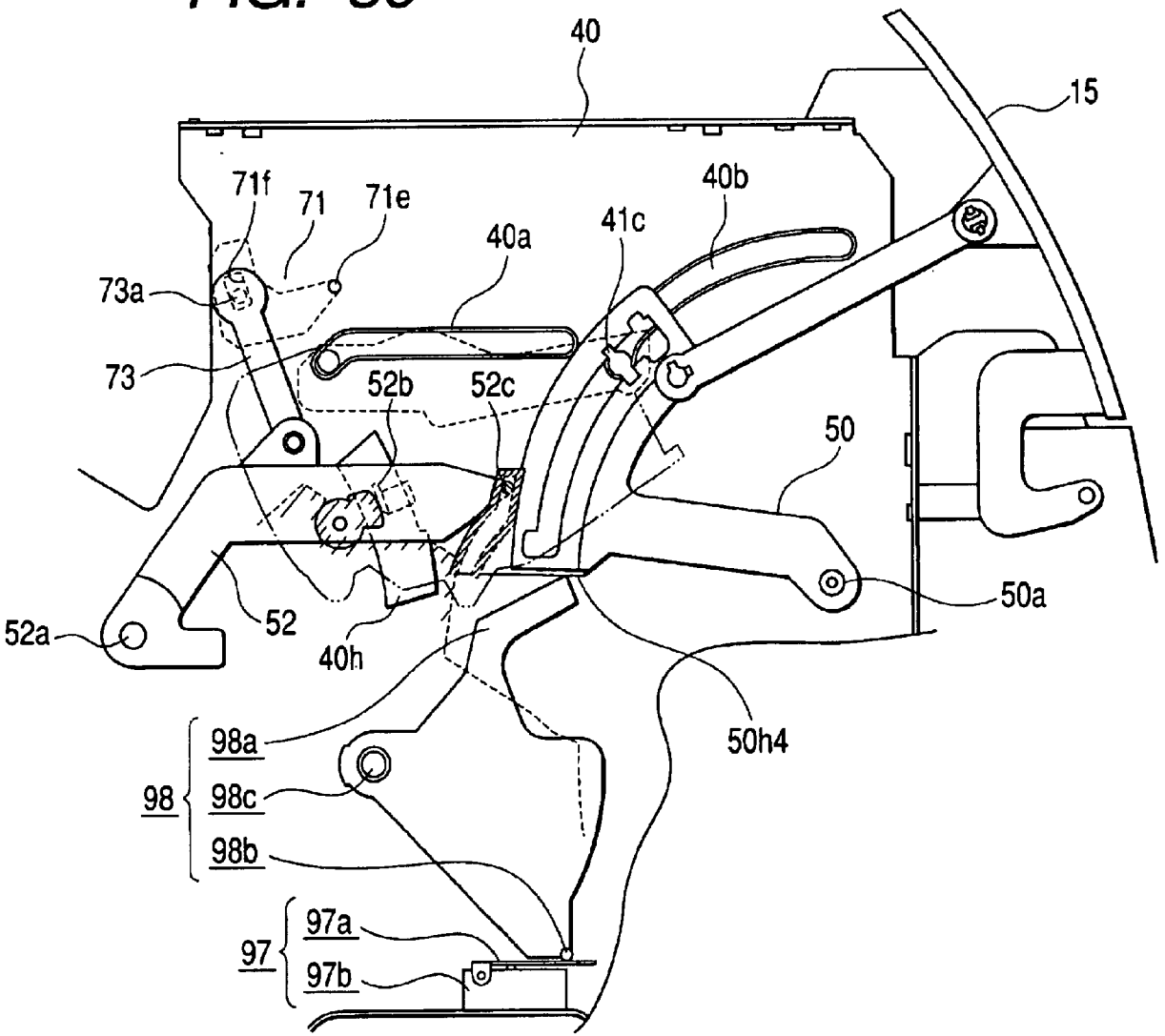
FIG. 30 is a longitudinal cross-sectional view of an apparatus main body in Embodiment 3.

While the description has hitherto been made of the case where the slide frame 75 and the compression coil spring 76 are provided in the connecting portion between the connector holder 71 and the link 73, a similar effect can also be obtained when as shown in FIG. 29, the fitting hole 52*d*1 in the connecting portion between the moving member 52 and the link 73 is made into a slot 52*d*2 and there are used there a slide frame 77 and a compression coil spring 78 for biasing the slide frame 77 toward the lower side of the slot 52*d*2.

As described above, the connecting portion of the link 73 of the connector mechanism is constituted by the slots 71*f*, 52*d*2 and provision is made of biasing means for biasing the coupling portion of the link 73, whereby during the retraction of the connector mechanism, no pressure force is applied, but only during the operation, a necessary pressure force can be obtained and therefore, it is possible to minimize the moment by the torsion coil spring 53 which is holding means for holding the connector mechanism in its retracted position.

Embodiment 3

Embodiment 3 of the connector mechanism will now be described. In Embodiment 3, portions functionally similar to those in Embodiment 1 are given the same reference characters.

Figure 32:
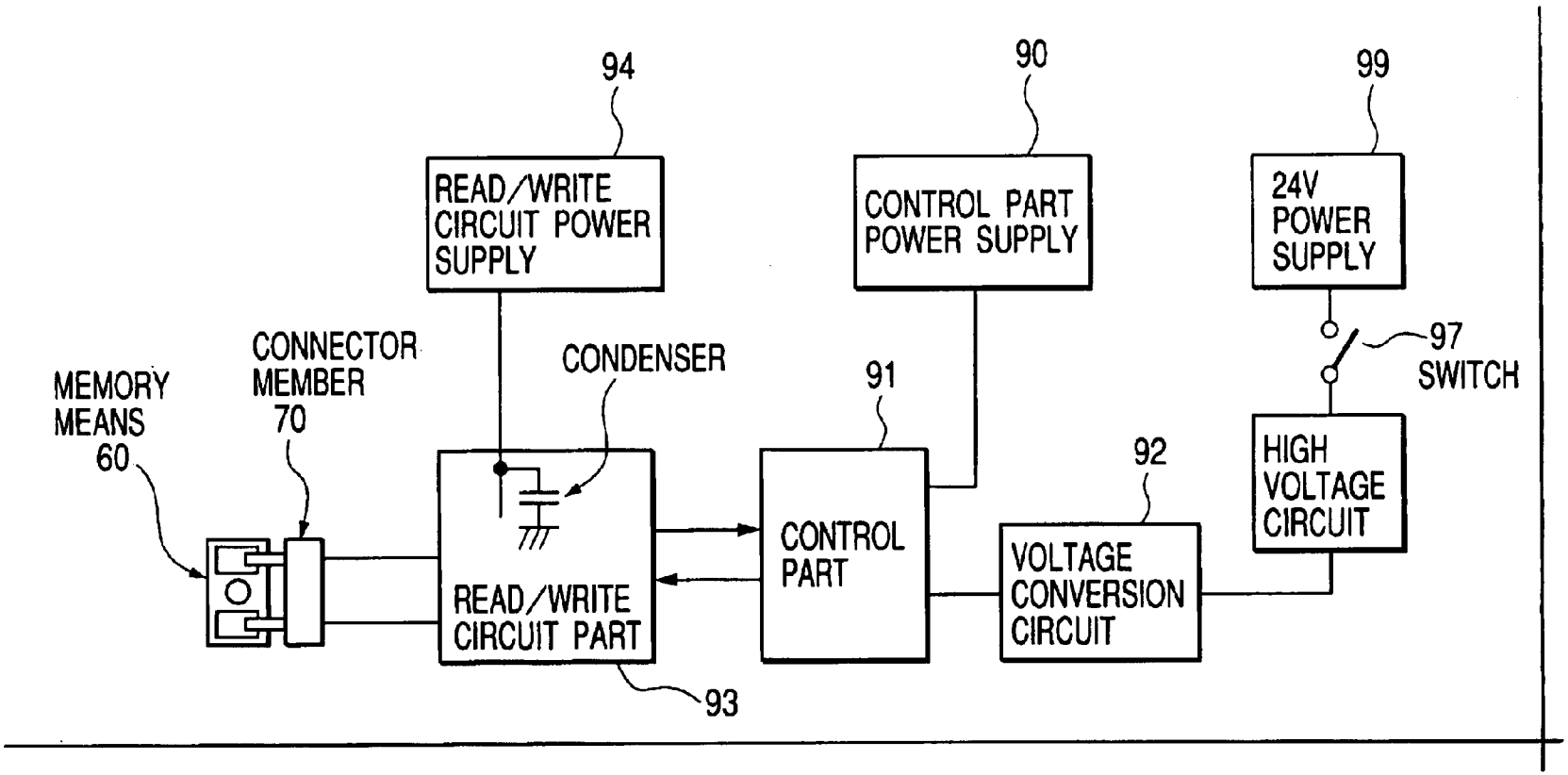
FIG. 32 is a circuit diagram regarding memory means and switches in Embodiment 3.

FIG. 3 shows the completely closed state of the openable and closable cover 15 (the closing position of the openable and closable cover 15). A switch 97 is provided in the main body of the image forming apparatus A. The switch 97, as shown in FIG. 32, is provided in a line in a circuit for supplying electric power (24V) to a control part 91 provided in the main body of the image forming apparatus A. Consequently, the switch 97 assumes a state (ON state) for connecting the circuit for supplying electric power to the main body (control part 91) of the image forming apparatus A when the openable and closable cover 15 is in its completely closed state (closing position), and the image forming apparatus A becomes operable. On the other hand, when the openable and closable cover 15 is in other position then its completely closed state (the closing position of the openable and closable cover 15), the switch 97 assumes a state (OFF state) for disconnecting the circuit for supplying electric power to the main body (control part 91) of the image forming apparatus A, and the image forming apparatus A assumes an inoperative state. That is, the switch 97 acts to prevent the image forming apparatus A from operating by mistake when the openable and closable cover is in its opened state.

A switch lever 98 is provided on the inner side plate 40 of the image forming apparatus A for rotation about a shaft 98*c*. In the completely closed state of the openable and closable cover 15, a third cam portion 50*h*4 of the cam plate 50 abuts the arm 98*a* of the switch lever 98, and the pressing portion 98*b* of the switch lever 98 presses the lever 97*a* of the switch lever 98 to thereby keep the switch 97 in its ON state.

When the openable and closable cover 15 is in its completely closed state, as described in Embodiment 1, the electrical contact 70*a* of the connector member 70 and the contact portion 60*b* of the tag chip 60 are electrically in contact with each other. Also, the biasing portion 52*b* of the moving member 52 contacts with the portion 18*a*1 to be biased of the positioning member 18*a* to thereby urge the positioning member 18*a* against the positioning portion 90*a*. That is, the process cartridge is positioned by the positioning portion 90*a*.

Figure 18:
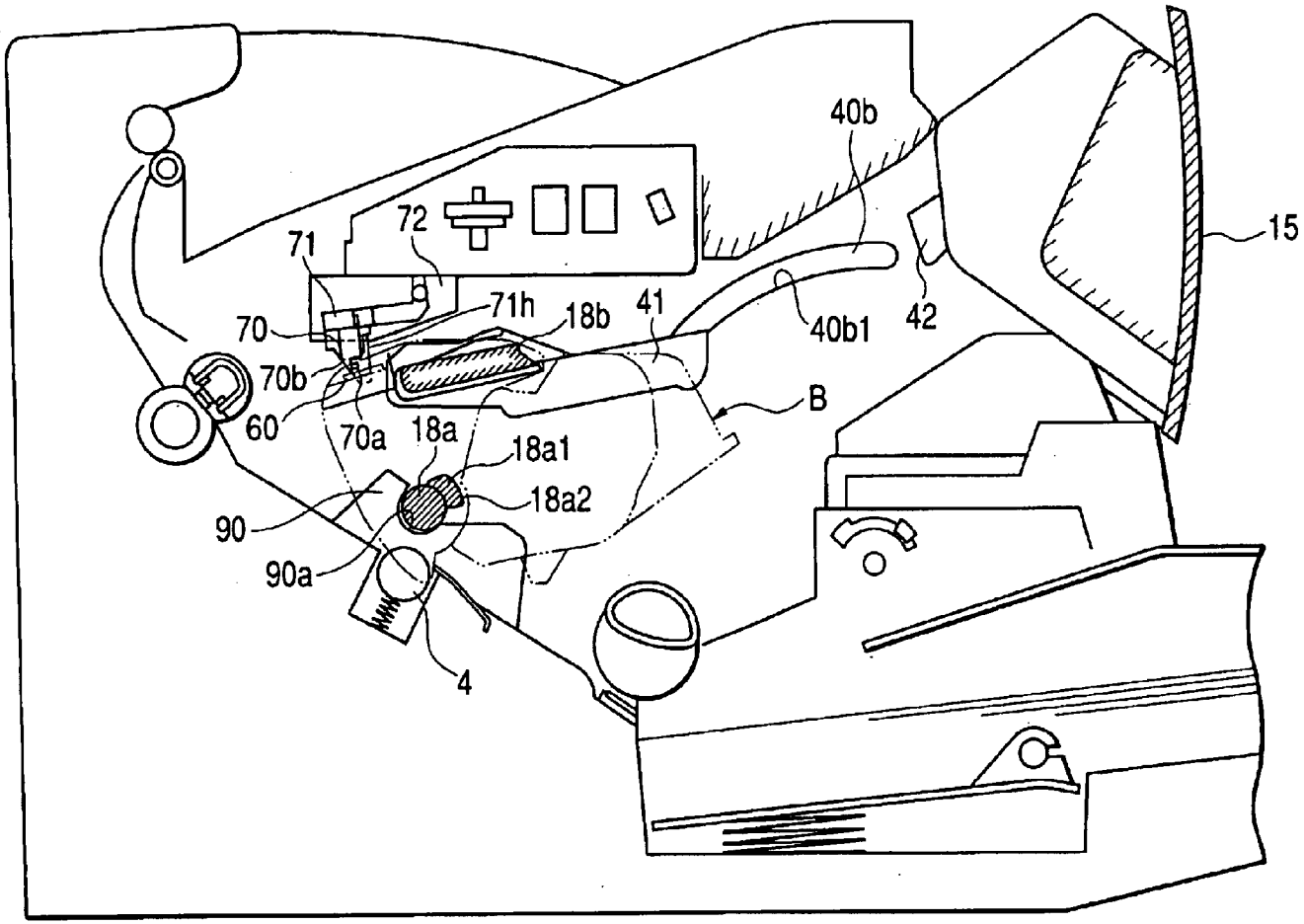
FIG. 18 is a longitudinal cross-sectional view of the apparatus main body showing the positioning means of the process cartridge and a movable connector mechanism in the state of FIG. 17.
Figure 31:
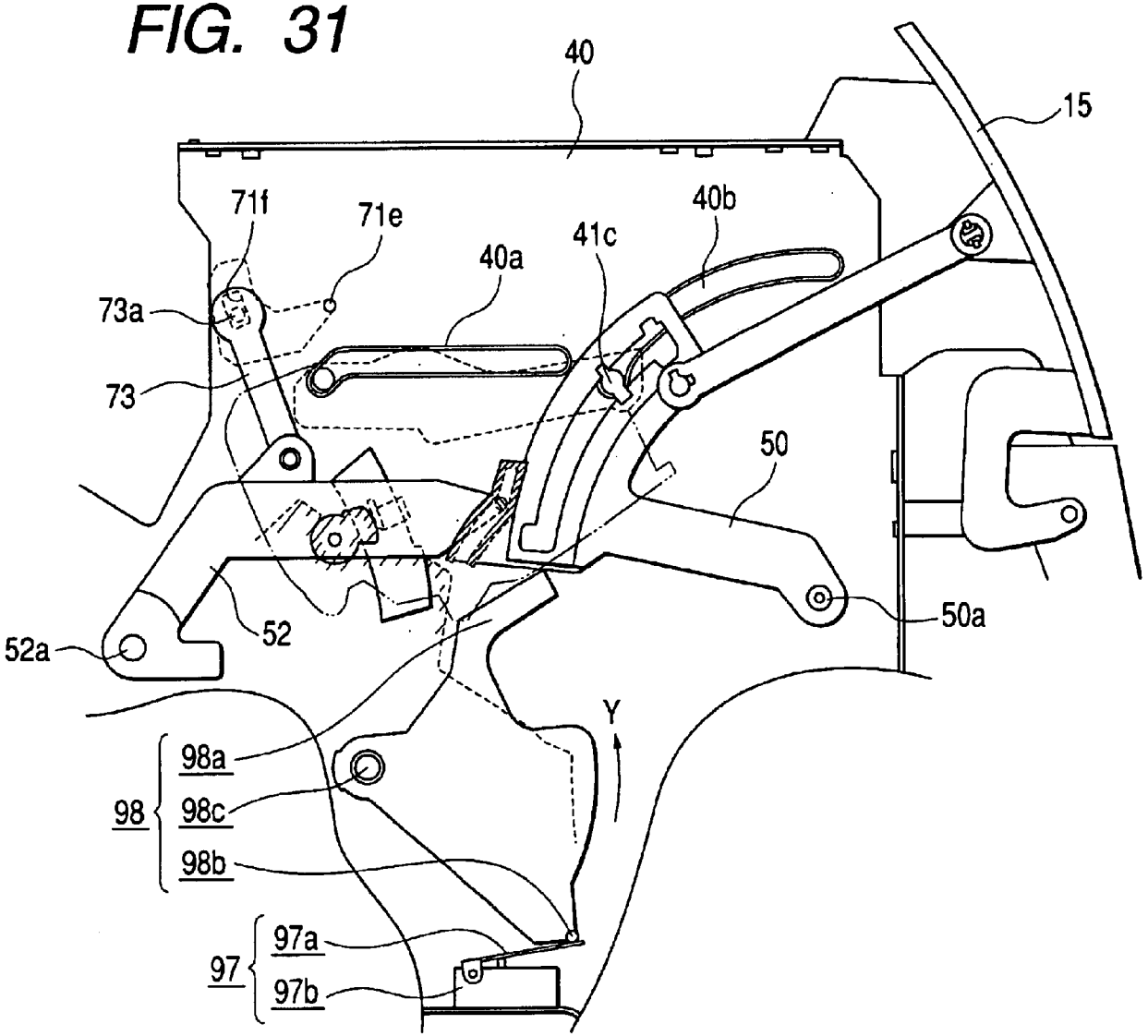
FIG. 31 is a longitudinal cross-sectional view of the apparatus main body in Embodiment 3.

FIG. 31 shows a state in which the openable and closable cover 15 is opened from its closing position, whereby the cam plate 50 coupled thereto by the connecting plate 51 has been rotated. As regards also the switch lever 98, the lever 97*a* of the switch 97 is rotated upwardly (in the direction of arrow Y) by the force of restitution thereof, and the switch 97 assumes its OFF state, and the circuit (FIG. 32) for supplying electric power to the main body of the image forming apparatus A is disconnected. This state is the same as the state of FIG. 24 in Embodiment 1, and the electrical contact 70*a* of the connector member 70 and the contact portion 60*b* of the tag chip 60 are electrically in contact with each other. When the switch 97 assumes its OFF state, during the time when the read/write circuit part 93 (FIG. 32) of the image forming apparatus A and the memory means 60 of the cartridge are effecting the exchange of information, that is, when they are effecting communication, control for terminating the communication is done from the control part 91 to the read/write circuit part 93 shown in FIG. 32. Further, when the openable and closable cover 15 is further opened, the moving member 52 is raised as shown in FIG. 23 of Embodiment 1. Then, the first shaft 73*a* of the link 73 abuts against the upper end of the slot 71*f* of the connector holder 71 to thereby raise the connector holder 71 upwardly. When the moving member 52 completely comes to its retracted position (FIG. 19), the dashing portion 70*b* and electrical contact 70*a* of the connector member 70 are spaced apart from the memory means 60 (FIG. 18).

That is, as described above, after the switch 97 has assumed its OFF state when the openable and closable cover 15 is opened from its closing position, if the read/write circuit part 93 (FIG. 32) of the image forming apparatus A and the memory means 60 of the cartridge are effecting communication, the communication between the read/write circuit part 93 (FIG. 32) and the memory means 60 of the cartridge is terminated by the control from the control part. Thereafter, the electrical contact 70*a* of the connector member 70 and the contact portion 60*b* of the tag chip 60 are spaced apart from each other and therefore, there is not the undesirable possibility that in the course of the communication between the read/write circuit part 93 (FIG. 32) and the memory means 60 of the cartridge, the communication is inadvertently interrupted and the data being communicated are lost.

In the other points, the construction of the present embodiment is similar to that of Embodiment 1.

As described above, according to the present invention, a main body electrical contact provided in an electrophotographic image forming apparatus and the cartridge electrical contact portion of memory means provided in a process cartridge detachably mountable on the main body of the apparatus can be reliably brought into contact with each other in a stable state.

Also, when a main body electrical contact provided in an electrophotographic image forming apparatus and the cartridge electrical contact portion of memory means provided in a process cartridge detachably mountable on the main body of the apparatus contact with each other, dust and stains adhering to the cartridge electrical contact portion can be removed and the two can be reliably brought into contact with each other.

Also, the accuracy of the position at which a main body electrical contact provides in an electrophotographic image forming apparatus and the cartridge electrical contact portion of memory means provided in a process cartridge detachably mountable on the main body of the apparatus contact with each other can be improved.

Also, design is made such that after a switch member provided in an electrophotographic image forming apparatus has changed from its ON state to its OFF state when an openable and closable cover is moved from the closing position to the opening position, a main body electrical contact portion and a cartridge electrical contact portion are electrically spaced apart from each other, whereby the main body electrical contact portion and the cartridge electrical contact portion can be prevented from being inadvertently spaced apart from each other.

What is claimed is:

1. An electrophotographic image forming apparatus onto which a process cartridge is detachably mountable, for forming an image onto a recording medium, the process cartridge having an electrophotographic photosensitive member, process means for acting on the electrophotographic photosensitive member, and memory means having a cartridge electrical contact, said apparatus comprising:

an opening through which the process cartridge is mounted and dismounted;

an openable and closable cover movable between an opening position for opening said opening and a closing position for closing said opening;

a main body positioning portion configured and positioned to position the process cartridge with respect to a main body of said electrophotographic image forming apparatus;

a main body electrical contact electrically connectable to the cartridge electrical contact; and a moving member movable in association with an opening or a closing operation of said openable and closable cover, and configured and positioned to move said main body electrical contact along a direction in which said main body electrical contact electrically contacts the cartridge electrical contact in the case that said openable and closable cover moves from the opening position to the closing position and the process cartridge is mounted in said electrophotographic image forming apparatus and to move the process cartridge along a direction in which the process cartridge is positioned at said main body positioning portion after said main body electrical contact is electrically in contact with the cartridge electrical contact when the process cartridge is mounted in said electrophotographic image forming apparatus.

2. An electrophotographic image forming apparatus according to claim 1, wherein said moving member is configured and positioned to move the process cartridge along a direction in which the process cartridge is positioned at said main body positioning portion by abutting on an urging portion to be urged when the process cartridge is mounted in said electrophotographic image forming apparatus, the urging portion being provided at the process cartridge.

3. An electrophotographic image forming apparatus according to claim 1, further comprising a movable connector mechanism operatively associated with said moving member, and configured and positioned to hold said main body electrical contact at a position spaced apart from the cartridge electrical contact when said openable and closable cover is in the opening position and the process cartridge is mounted in said electrophotographic image forming apparatus, and to move said main body electrical contact in a direction in which said main body electrical contact and the cartridge electrical contact are electrically connected together when said openable and closable cover is moved from the opening position to the closing position and the process cartridge is mounted in said electrophotographic image forming apparatus.

4. An electrophotographic image forming apparatus according to claim 3, wherein said movable connector mechanism has a housing fixed to the main body of said electrophotographic image forming apparatus, a connector holder rotatably supported by said housing and holding said main body electrical contact, and a link configured and positioned to connect said connector holder and said moving member together.

5. An electrophotographic image forming apparatus according to claim 4, wherein said connector holder is further supported for movement in the axial direction of a rotary shaft about which said connector holder is rotated relative to said housing, wherein the axial direction is a direction orthogonal to a mounting direction in which the process cartridge is mounted on the main body of said electrophotographic image forming apparatus, and said connector holder has main body electrical contact positioning means for moving by following the process cartridge in the axial direction.

6. An electrophotographic image forming apparatus according to claim 5, wherein said main body electrical contact positioning means has a positioning rib engaged with a slit provided in the process cartridge when the process cartridge is mounted on the main body of said electrophotographic image forming apparatus.

7. An electrophotographic image forming apparatus according to claim 4, wherein said movable connector mechanism further comprises:

an elastic member, provided between said housing and said connector holder, configured and positioned to press the cartridge electrical contact toward said main body electrical contact; and a shaft engaged with said connector holder provided in said link and configured and positioned to move said connector holder along a direction from said main body electrical contact to the cartridge electrical contact in the case that said openable and closable cover is moved from the opening position to the closing position and the process cartridge is mounted in said electrophotographic image forming apparatus.

8. An electrophotographic image forming apparatus according to claim 4, wherein said movable connector mechanism further includes:

a shaft engaged with said connector holder provided in said link and configured and positioned to move said connector holder along a direction from said main body electrical contact to the cartridge electrical contact in the case that said openable and closable cover is moved from the opening portion to the closing position when the process cartridge is mounted in said electrophotographic image forming apparatus;

a slot engaged with said shaft and provided in said connector holder; and an elastic member provided between said shaft and said slot, and configured and positioned to press the cartridge electrical contact toward said main body electrical contact when the process cartridge is mounted in said electrophotographic image forming apparatus.

9. An electrophotographic image forming apparatus according to claim 2, further comprising:

a moving guide configured and positioned to transport the process cartridge from said opening to said main body positioning portion; and a second moving member rotatably provided on the main body of said electrophotographic image forming apparatus, configured and positioned to rotate in association with an opening operation or a closing operation of said openable and closable cover, said second moving member including:

a first cam portion configured and positioned to move said moving guide to transport the process cartridge to said main body positioning portion in the case that said openable and closable cover moves from the opening position to the closing position when the process cartridge is mounted in said electrophotographic image forming apparatus; and a second cam portion configured and positioned to move said moving member to electrically connect said main body electrical contact and the cartridge electrical contact after said moving guide is moved and thereafter causing the urging portion to be urged to abut against said moving member.

10. An electrophotographic image forming apparatus according to claim 2, wherein said moving member has an urging portion to abut the portion to be urged at the process cartridge.

11. An electrophotographic image forming apparatus onto which a process cartridge is detachably mountable, for forming an image onto a recording medium, the process cartridge having an electrophotographic photosensitive, process means for acting on the electrophotographic photosensitive member, and memory means having a cartridge electrical contact, said apparatus comprising:

an opening through which the process cartridge is mounted and dismounted;

an openable and closable cover movable between an opening position for opening said opening and a closing position for closing said opening;

a switch member capable of being in an ON state for supplying electric power to a main body of said electrophotographic image forming apparatus in the case that said openable and closable cover is in the closing portion, and being in an OFF state for not supplying electric power to the main body of said electrophotographic image forming apparatus in the case that said openable and closable cover is in a position other than the closing position;

a main body electrical contact electrically connectable to the cartridge electrical contact;

a first moving member configured and positioned to move said main body electrical contact along a direction in which said main body electrical contact electrically contacts the cartridge electrical contact or said main body electrical contact electrically disconnects from the cartridge electrical contact when the process cartridge is mounted in said electrophotographic image forming apparatus; and a second moving member configured and positioned to move in association with an opening or closing operation of said openable and closable cover, and to turn said switch member from the ON state to the OFF state in accordance with an operation in which said openable and closable cover is moved from the closing position to a position other than the closing position and then moving said first moving member along a direction in which the cartridge electrical contact is electrically disconnected from said main body electrical contact portion when the process cartridge is mounted in said electrophotographic image forming apparatus.

12. An electrophotographic image forming apparatus according to claim 11, further comprising:

a movable connector mechanism operatively associated with said first moving member and configured and positioned to hold said main body electrical contact in a position for electrically separating said main body electrical contact from the cartridge electrical contact in the case that said openable and closable cover is in the opening position and the process cartridge is mounted in said electrophotographic image forming apparatus, and to move said main body electrical contact in a direction in which said main body electrical contact and the cartridge electrical contact are electrically connected together in the case that said openable and closable cover is moved from the opening position to the closing position and the process cartridge is mounted in said electrophotographic image forming apparatus.

13. An electrophotographic image forming apparatus according to claim 12, wherein said movable connector mechanism has a housing fixed to the main body of said electrophotographic image forming apparatus, a connector holder rotatably supported by said housing and configured and positioned to hold said main body electrical contact, and a link configured and positioned to connect said connector holder and said first moving member together.

14. An electrophotographic image forming apparatus according to claim 11, further comprising:

a switch lever, movably provided in the main body of said electrophotographic image forming apparatus, configured and positioned to operate said switch member;

wherein said second moving member is provided on the main body of said electrophotographic image forming apparatus, and wherein said second moving member includes a first cam part configured and positioned to move said first moving member to electrically connect said main body electrical contact to or disconnect said main body electrical contact from the cartridge electrical contact, and a second cam part configured and positioned to move said switch lever to turn said switch member from the ON state to the OFF state or from the OFF state to the ON state.

15. An electrophotographic image forming apparatus onto which a process cartridge is detachably mountable, for forming an image onto a recording medium, the process cartridge having an electrophotographic photosensitive member, process means for acting on the electrophotographic photosensitive member, and memory means having a cartridge electrical contact, said apparatus comprising:

an opening through which the process cartridge is mounted and dismounted;

an openable and closable cover movable between an opening position for opening said opening and a closing position for closing said opening;

a main body positioning portion configured and positioned to position the process cartridge with respect to a main body of said electrophotographic image forming apparatus;

a main body electrical contact electrically connectable to the cartridge electrical contact; and positioning means for electrically connecting said main body electrical contact to the cartridge electrical contact in accordance with an operation in which said openable and closable cover moves from the opening position to the closing position when the process cartridge is mounted in said electrophotographic image forming apparatus, and for positioning the process cartridge at said main body positioning portion when the process cartridge is mounted in said electrophotographic image forming apparatus.

16. An electrophotographic image forming apparatus onto which a process cartridge is detachably mountable, for forming an image onto a recording medium, the process cartridge having an electrophotographic photosensitive member, process means for acting on the electrophotographic photosensitive member, and memory means having a cartridge electrical contact, said apparatus comprising:

an opening through which the process cartridge is mounted and dismounted;

an openable and closable cover configured and positioned to open and close said opening, and movable between an opening position for opening said opening and a closing position for closing said opening;

a switch member capable of assuming an ON state for supplying electric power to a main body of said electrophotographic image forming apparatus in the case that said openable and closable cover is in the closing position, and capable of assuming an OFF state for not supplying electric power to the main body of said electrophotographic image forming apparatus in the case that said openable and closable cover is in a position other than the closing position;

a main body electrical contact electrically connectable to the cartridge electrical contact; and means for causing said switch member to turn from the ON state to the OFF state in accordance with an operation in which said openable and closable cover is moved from the closing position to a position other than the closing position and then moving a moving member along a direction to electrically disconnect the cartridge electrical contact from said main body electrical contact.

* * * * *

UNITED STATES PATENT AND TRADEMARK OFFICE

CERTIFICATE OF CORRECTION

PATENT NO. : 6,876,826 B2
DATED : April 5, 2005
INVENTOR(S) : Shinya Noda et al.

It is certified that error appears in the above-identified patent and that said Letters Patent is hereby corrected as shown below:

Column 22,
Line 45, "photosensitive," should read -- photosensitive member, --.

Signed and Sealed this

Thirtieth Day of August, 2005

JON W. DUDAS
*Director of the United States Patent and Trademark Office*